US006066444A

United States Patent [19]

Fujita

[11] Patent Number: 6,066,444

[45] Date of Patent: May 23, 2000

[54] SILVER HALIDE LIGHT SENSITIVE PHOTOGRAPHIC MATERIAL

[75] Inventor: Akio Fujita, Hino, Japan

[73] Assignee: Konica Corporation, Tokyo, Japan

[21] Appl. No.: 09/328,679

[22] Filed: Jun. 9, 1999

[30] Foreign Application Priority Data

Jun. 15, 1998 [JP] Japan ..... 10-166814

[51] Int. Cl.[7] ..... G03C 1/08

[52] U.S. Cl. ..... 430/604; 430/264; 430/608; 430/612

[58] Field of Search ..... 430/264, 604, 430/608, 612

[56] References Cited

U.S. PATENT DOCUMENTS 3,178,289 4/1965 Sottysiak .
4,329,417 5/1982 Nagatani et al. ..... 430/604
5,185,241 2/1993 Inoue ..... 430/604

FOREIGN PATENT DOCUMENTS 0 304 296 A2 2/1989 European Pat. Off. .
0 401 826 12/1990 European Pat. Off. .
0 774 687 A1 5/1997 European Pat. Off. .

*Primary Examiner*—Janet Baxter
*Assistant Examiner*—Amanda C. Walke
*Attorney, Agent, or Firm*—Frishauf, Holtz, Goodman, Langer & Chick, P.C.

[57] ABSTRACT

A silver halide light sensitive photographic material is disclosed, comprising a support having thereon one or plural photographic component layers, wherein at least a photographic component layer contains a lanthanoid triflate compound represented by the following formula:

$$Ln—(CF_3SO_3)_3$$

where Ln represents a rare earth element.

15 Claims, No Drawings

SILVER HALIDE LIGHT SENSITIVE PHOTOGRAPHIC MATERIAL

FIELD OF THE INVENTION

The present invention relates to a silver halide light sensitive photographic material (hereinafter, also denoted as a light sensitive photographic material or photographic material), specifically to a black-and-white photographic material, and in particular to a silver halide photographic material for use in graphic arts, which is rapid-processable, achieving a high maximum density and a low fog density, having a high contrast and being improved in abrasion marks and pepper fog, and an image forming process by use thereof.

BACKGROUND OF THE INVENTION

In the image processing process of photographic materials, systematization in the form of directly outputting from an image setter after editing on the system has become popular, along with recent advancements in digitization. Desired as a photographic material suitable for such a working form is a photographic material with high contrast and high stability when exposed to extremely short exposure of $10^{-6}$ sec. or less, with laser light. Since outputting from the image setter conventionally took a long time for developing image data in RIP, there was no particular concern for the processing speed. However, along with recent marked enhancement of operation speed, the processing speed of photographic materials has become a rate-determining factor in enhancing productivity of the image setter. Speed-up of processing is so strongly demanded that there is also strongly desired achievement of high contrast and high stability not only in extremely short exposure of $10^{-6}$ sec or less with laser light but also in very rapid processing of the total processing time (Dry to Dry) of less than 55 sec, and specifically less than 20 sec. In photographic materials, on the other hand, increasing the content of a hydrazine compound as a nucleating agent or raising the processing temperature to accelerate the processing speed, resulted in producing problems such as pepper fog or abrasion marks. Saccharides were also incorporated to promote faster processing. However, the saccharides often leached out of the processed material into the processing solution to form the main component of stains, producing product defects such as stain adhesion. Since it is difficult to install a stain-preventing apparatus in terms of spatial limitations, improvements in the photographic material are desired instead.

SUMMARY OF THE INVENTION

An object of the present invention is to provide a silver halide light sensitive photographic material with sufficient sensitivity and being superior in high contrast and stability, and an image forming process by use thereof.

The object of the invention can be accomplished by the following constitution:

a silver halide light sensitive photographic material comprising a support having thereon one or more photographic component layers, wherein at least a photographic component layer contains a lanthanoid triflate compound represented by the following formula (I)

$$Ln—(CF_3SO_3)_3 \qquad \text{formula (I)}$$

wherein Ln represents a rare earth element; and a silver halide light sensitive photographic material comprising a support subbed with gelatin having thereon a silver halide emulsion layer and a hydrophilic colloidal layer, wherein the silver halide emulsion layer and/or hydrophilic colloidal layer contain a lanthanoid triflate compound represented by the following formula:

$$Ln—(CF_3SO_3)_3 \qquad \text{formula I}$$

where Ln represents a rare earth element.

DETAILED DESCRIPTION OF THE INVENTION

The present invention can be applied to silver halide light sensitive photographic materials including silver halide black-and-white photographic material for use in graphic arts or radiography, silver halide color photographic materials such as 35 mm negative films and APS negative films, and thermally processable silver halide photographic materials; and preferably to silver halide photographic materials for use in graphic arts.

The expression, the photographic component layer(s) refer to layer(s) constituting a silver halide photographic material. The photographic component layer(s) include any layer except a support. Examples thereof include a silver halide emulsion layer, light-insensitive hydrophilic colloidal layer (including a protective layer, interlayer and gelatin sublayer), sublayer and hydrophobic binder layer.

The present invention can be applied to a silver halide photographic material having, as a component layer, a silver halide emulsion layer alone, and a silver halide photographic material having plural component layers including a silver halide emulsion layer and a protective layer.

The lanthanoid triflate compound used in the invention is preferably incorporated in a layer of the emulsion side, such as a silver halide emulsion layer. In cases where incorporated in a layer other than a silver halide emulsion layer, the lanthanoid triflate compound is incorporated preferably in a layer adjacent to the silver halide emulsion layer. Embodiments of the present invention are mainly directed to silver halide photographic materials for use in graphic arts, but are by no means limited to these.

There will be further described the lanthanoid triflate compounds used in the invention, specifically those represented by formula I. In formula I, Ln represents a rare earth element, including Yb, Sm, Sc, Y, La, Pr, Nd, Eu, Gd, Dy, Ho, Er, Tm and Lu atoms.

Examples of the compound represented by formula I include $(CF_3SO_3)_3Yb$, $(CF_3SO_3)_3Sm$, and $(CF_3SO_3)_3Sc$. In addition thereto, compounds including, as a co-ordinated metal, Y, La, Pr, Nd, Eu, Gd, Dy, Ho, Er, Tm and Lu are available. These compounds are also commercially available, for example, from Aldrich Chem. Co. The lanthanoid triflate compounds are compounds which are noteworthy in the field of organic synthesis, as a Lewis acid catalyst capable of stably acting in water. It was found by the inventor of the present invention that when applied to silver halide photographic materials, these compounds promoted development nucleation by hydrazine. It was further found that the lanthanoid triflate compounds, which function as a catalyst, accelerate development of silver halide. This was confirmed from the fact that when a lanthanoid triflate compound was incorporated into an emulsion containing no hydrazine compound, an increased developing rate was observed. Thus, it was proved that incorporation of the lanthanoid triflate compound into a photographic material resulted in enhances sensitivity as well as accelerated developing speed, irrespective of the coexistence of a hydrazine compound. It was also proved that when the lanthanoid triflate compound was allowed to exist in a photographic material containing a hydrazine compound, development nucleation by the hydrazine compound took place more rapidly, leading to a high contrast photographic material. The mechanism thereof has not yet been definitely clarified, but it is presumed that adsorption of the lanthanoid triflate compound onto the hydrazine compound lowers the activation energy of the hydrazine reaction and accelerates hydrolysis even under conditions in which hydrolysis of the hydrazine compound does not usually occur. It is alternatively presumed that the lanthanoid triflate compound attracts a hydroxy ion, promoting hydrolysis of the hydrazine compound.

The lanthanoid triflate compound may be added at any time during physical ripening (grain formation) or chemical ripening, or after completing chemical ripening and to an emulsion layer and/or a hydrophilic colloidal layer (and preferably to the emulsion layer). It is preferred that when the lanthanoid triflate compound is allowed to be present in an emulsion, sensitivity and high contrast can be achieved with a less than conventional hydrazine amount. The lanthanoid triflate compound is contained preferably in an amount of 0.2 to 300 mg, and more preferably 1 to 100 mg per mol of silver halide.

Enhanced sensitivity can be achieved without increasing the hydrazine compound. In other words, if sensitivity is maintained at the same level, it enables reduction of the hydrazine amount, leading to reduction in pepper fog and abrasion marks. Even in cases where the hydrazine compound is used in a conventional amount, the addition amount of saccharides such as dextran can be reduced, leading to reduction in stains. Thus, compared to conventional photographic materials containing a hydrazine compound, various improvements as described above can be achieved.

A silver halide emulsion layer and/or a hydrophilic colloidal layer contain a hydrazine compound to achieve contrast increase. Preferred hydrazine compounds are represented by the following formula (H):

Formula (H)

formula [H]

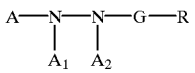

wherein A is an aryl group or a heterocyclic group containing an oxygen or sulfur atom; G is $—(CO)_n—$, $—P(=O)R_2—$, a sulfonyl group, sulfoxy group or iminomethylene group, in which n is 1 or 2, and $R_2$ is an alkyl group, alkenyl group, alkynyl group, aryl group, alkoxy group, alkenyloxy group, alkynyloxy group, aryloxy group or amino group; $A_1$ and $A_2$ are both hydrogen atoms, or one of them is a hydrogen atom and the other is an alkylsulfonyl group or acyl group; R is a hydrogen atom, alkyl group, alkenyl group, aryl group, alkoxy group, alkenyloxy group, aryloxy group, heterocyclic-oxy group, amino group, carbamoyl group or oxycarbonyl group.

Of compounds represented by formula (H), a compound represented by the following formula (Ha) is more preferable:

Formula (Ha)

formula (Ha)

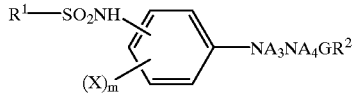

wherein $R^1$ is an aliphatic hydrocarbon group (e.g., octyl, decyl), aromatic hydrocarbon group (e.g., phenyl, 2-hydroxyphenyl, chlorophenyl) or heterocyclic group (e.g., pyridyl, thienyl, furyl), each of which may be substituted. Further, it is also preferable that $R^1$ contains at least one ballast group or a silver halide adsorption-promoting group (i.e., a group for promoting adsorption onto silver halide).

As a ballast groups which are commonly used in the immobile photographic additives such as couplers are preferable, and examples of the ballast groups include an alkyl group, an alkenyl group, an alkynyl group, an alkoxy group, a phenyl group, a phenoxy group, an alkylphenoxy group, etc., which are relatively photographically inert.

The silver halide adsorption-promoting group includes, for example, a thiourea group, a thiourethane group, a mercapto group, a thioether group, a thione group, a heterocyclic group, a thioamide heterocyclic group, mercapto heterocyclic group, or adsorbing groups as disclosed in JP-A 64-90439.

In the formula (Ha), X represents a group which is capable of being a substituent on a phenyl group, m represents an integer of 0 to 4, provided when m is 2 or more, X may be the same or different.

In the formula (Ha), A and $A_4$ independently have the same definition as A1 and A2, respectively.

In the formula (Ha), G represents a carbonyl group, a sulfonyl group, a sulfoxy group, a phosphoryl group or an iminomethylene group, and carbonyl group is preferable as G.

In the formula (Ha), $R^2$ represents a hydrogen atom, an alkyl group, an alkenyl group, an alkynyl group, an aryl group, a heterocyclic group, an alkoxy group, a hydroxy group, an amino group, a carbamoyl group, a $—CON(R^4)(R^5)$ group, etc. can be mentioned (in which $R^3$ represents an alkynyl group or a saturated heterocyclic group; $R^4$ represents a hydrogen atom, an alkyl group, an alkenyl group, an alkynyl group, an aryl group or a heterocyclic group; and $R^5$ represents an alkenyl group, an alkynyl group, a saturated heterocyclic group, a hydroxy group or an alkoxy group).

Exemplary examples of the compound represented by formula (H) or (Ha) are given below, however, the compound is limited to these examples.

H-1
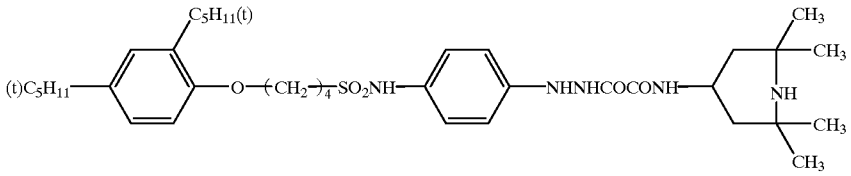
H-2
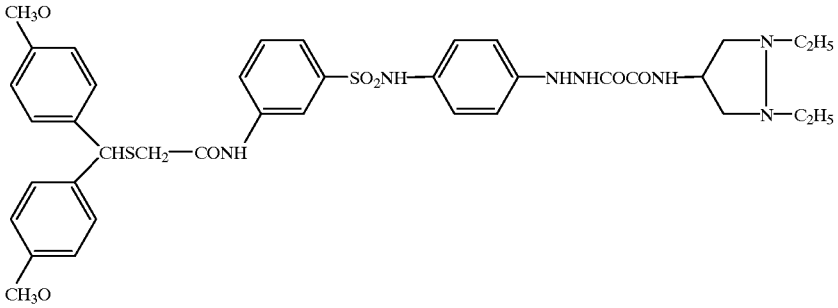
H-3
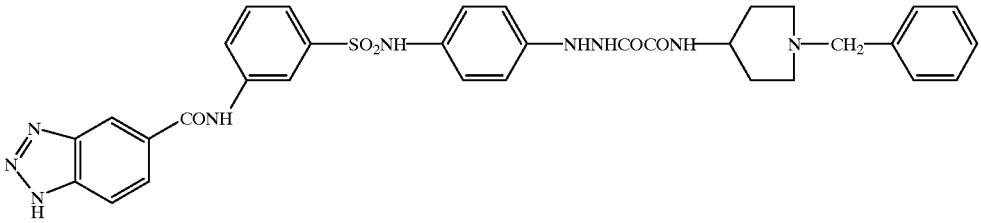
H-4
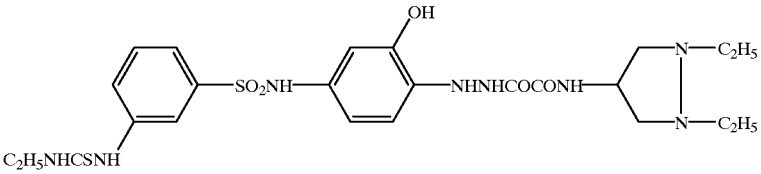
H-5
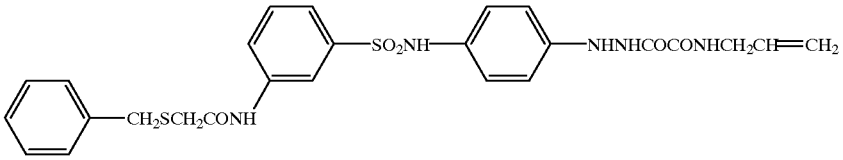
H-6
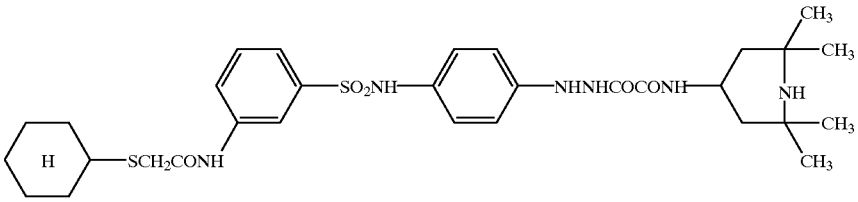

-continued
H-7
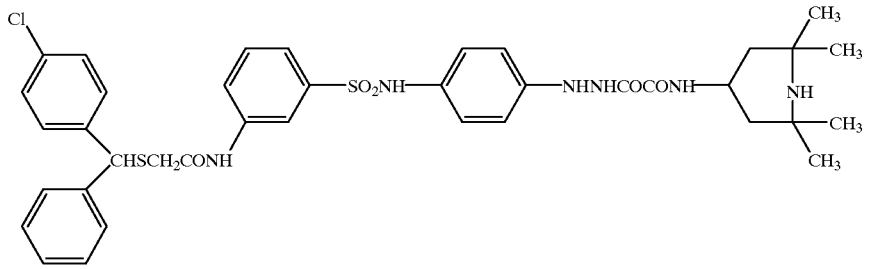
H-8
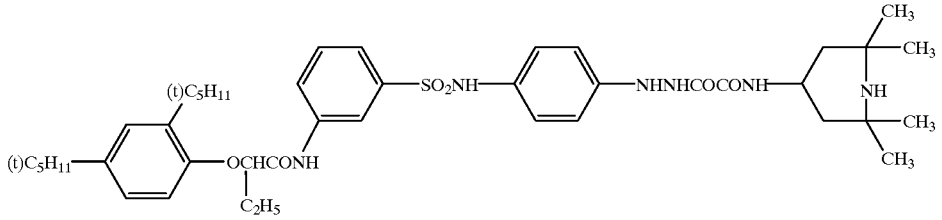
H-9
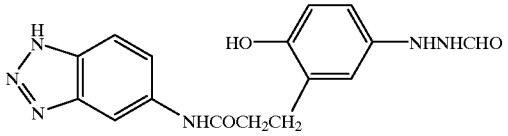
H-10
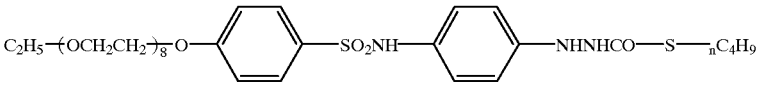
H-11
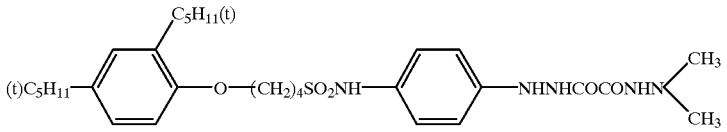
H-12
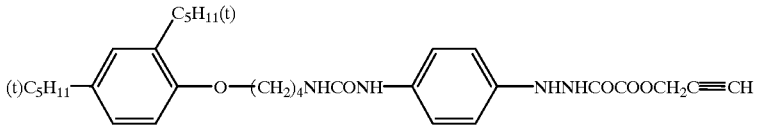
H-13
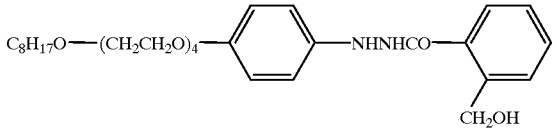
H-14
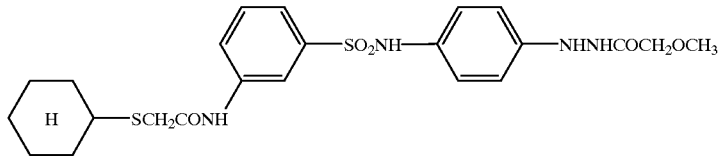

-continued
H-15
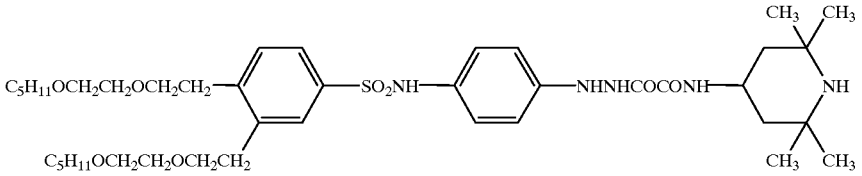
H-16
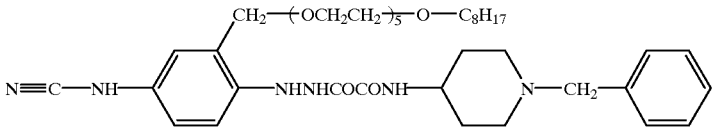
H-17
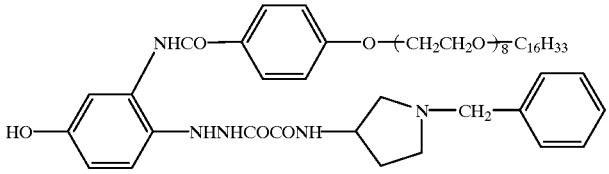
H-18
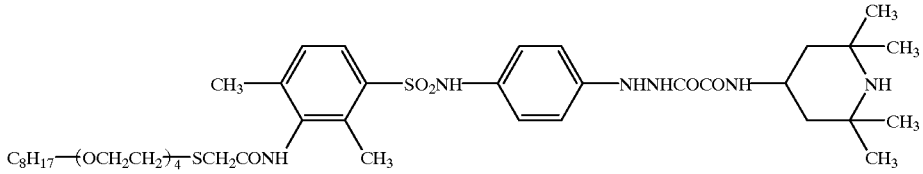
H-19
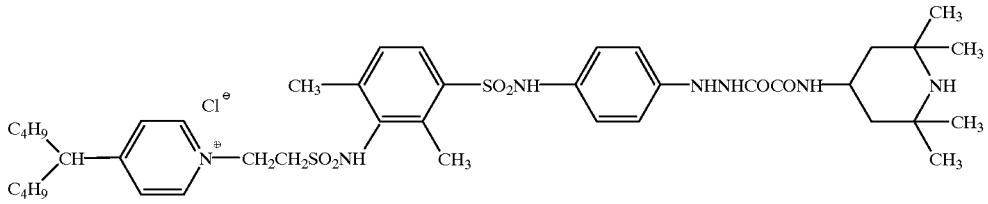
H-20
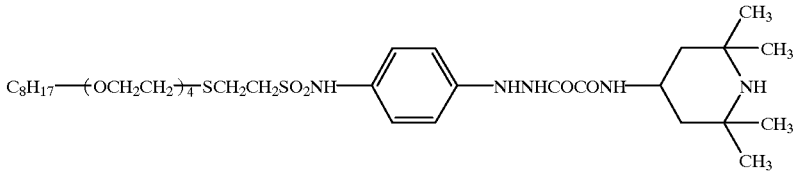
H-21
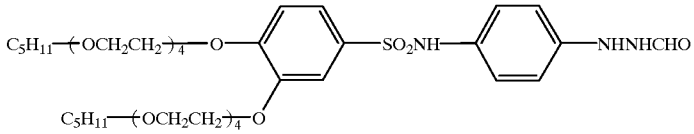
H-22
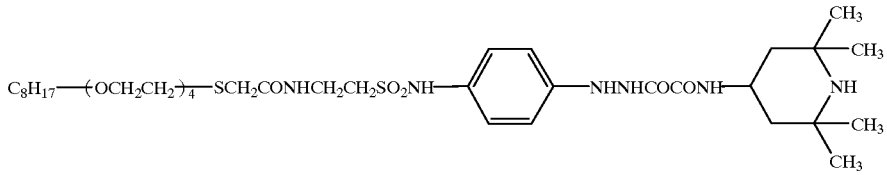

-continued

H-23

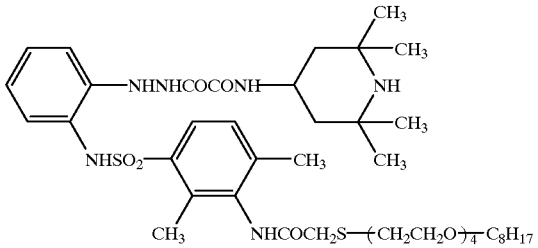

H-24

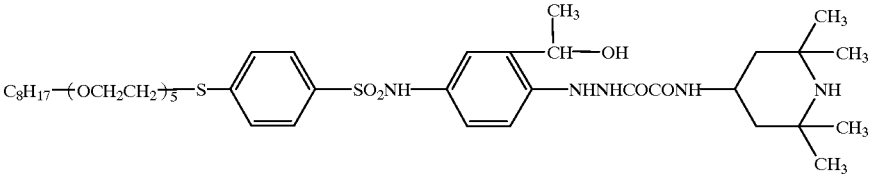

H-25

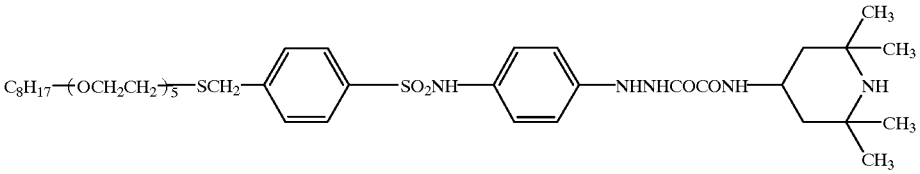

In addition, exemplary and preferred hydrazine derivatives include exemplified Compounds (1) through (252) disclosed on columns 59 through 80 of U.S. Pat. No. 5,229,248.

The hydrazine derivatives usable in the invention can be synthesized according to the conventionally known methods in the art. For example, they may be synthesized according to the method disclosed on columns 59 through 80 in the U.S. Pat. No. 5,229,248.

The hydrazine derivative may be added in an amount capable of contrast-increasing the light-sensitive photographic material according to the present invention, and the optimum amount of addition may be varied depending on the size, halide composition, degree of chemical ripening of silver halide grains and kind of restraining agent used, however, it is generally between $10^{-6}$ and $10^{-1}$ mol, and, more preferably, between $10^{-5}$and $10^{-2}$ mol per one mol of silver halide.

The hydrazine derivative may be incorporated into any layer on the emulsion-side, and preferably incorporated either into the silver halide emulsion layer or a layer adjacent thereto.

The addition amount may be varied depending on the size, halide composition, degree of chemical ripening of silver halide grains and kind of restraining agent used, however, it is generally between $10^{-6}$ and $10^{-1}$ mol, and, more preferably, between $10^{-5}$ and $10^{-2}$ mol per one mol of silver halide.

In order to promote effectively contrast-increasing by the hydrazine compound, it is preferable to use a nucleation promoting compound represented by the following general formula (Na) or (Nb).

formula (Na)

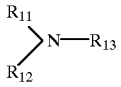

formula (Nb)

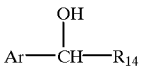

In the formula (Na), $R_{11}$, $R_{12}$ and $R_{13}$ independently represent a hydrogen atom, an alkyl group, a substituted alkyl group, an alkenyl group, a substituted alkenyl group, an alkynyl group, an aryl group or a substituted aryl group, provided that $R_{11}$, $R_{12}$ and $R_{13}$ can combine with each other to form a ring. Among the compounds represented by formula (Na) is preferable an aliphatic tertiary amine compound. It is preferable for these compounds to contain in their molecules a diffusion-proof group (or ballast group) or a silver halide-adsorption-promoting group. In order to be non-diffusible, the compound has preferably a molecular weight of not less than 100, and more preferably, a molecular weight of not less than 300. Preferred adsorption-promoting groups include a heterocyclic group, a mercapto group, a thioether group, a thione group, thiourea group. Particularly preferred compound represented by the general formula (Na) include a compound having in its molecule at least one thioether group as the silver halide adsorption-promoting group.

Exemplary nucleation accelerating compounds represented by formula (Na) are given below.

Na-1

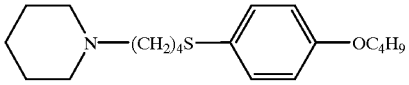

Na-2

$[(C_3H_7)_2N(CH_2)_3OCH_2CH_2]_2S$

Na-3

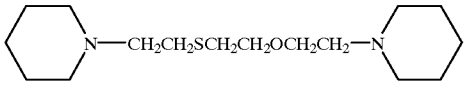

Na-4

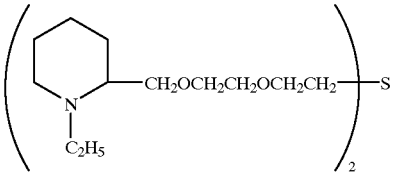

Na-5

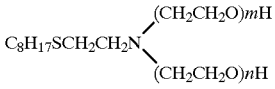

$m + n = 20$

Na-6

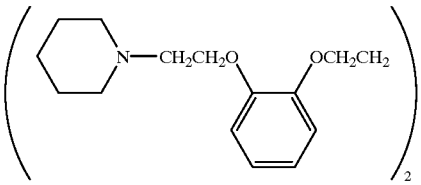

Na-7

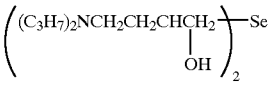

Na-8

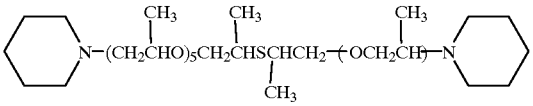

Na-9

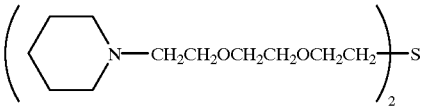

Na-10

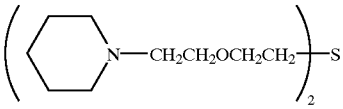

Na-11

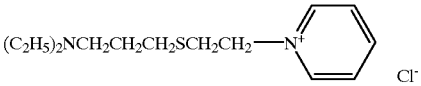

Na-12

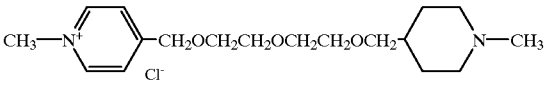

-continued

Na-13

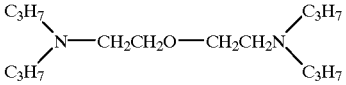

Na-14

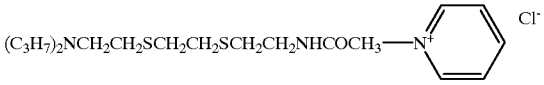

Na-15

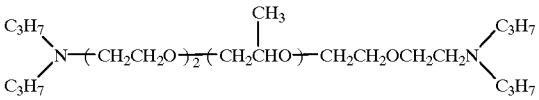

Na-16

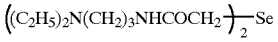

Na-17

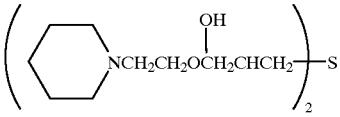

Na-18

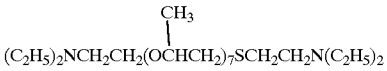

Na-19

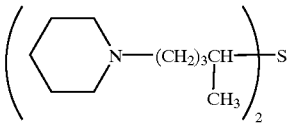

Na-20

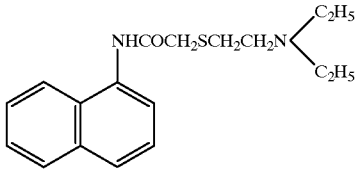

Na-21

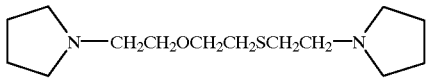

In formula (Nb), Ar represents a substituted or unsubstituted aromatic hydrocarbon group or a heterocyclic group. $R_{14}$ represents a hydrogen atom, an alkyl group, an alkenyl group, an alkynyl group, or an aryl group, provided that Ar and $R_{14}$ may be linked to form a ring. The compound preferably contain in its molecule an diffusion-proof group or a silver halide adsorption-promoting group. The molecular weight to confer diffusion-proof property on the compound is 120 or more, and, more preferably, 300 or more. Further, preferred silver halide adsorption-promoting groups are the same as defined in the formula (H).

Exemplary compounds represented by formula (Nb) are given below.

Nb-1
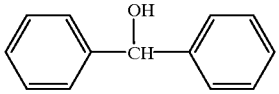
Nb-2
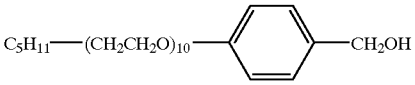
Nb-3
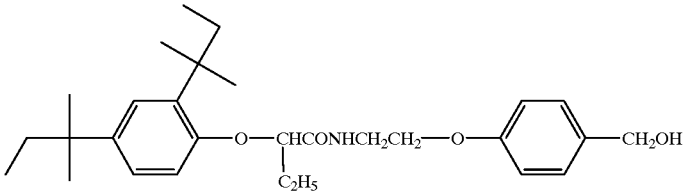
Nb-4
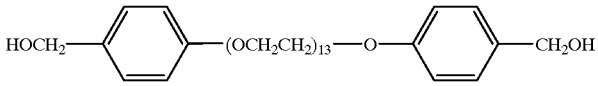
Nb-5
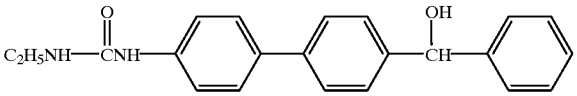
Nb-6
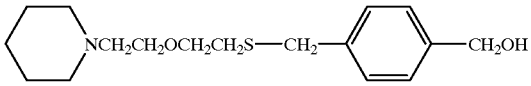
Nb-7
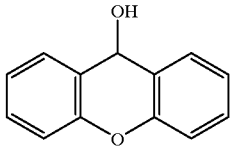
Nb-8
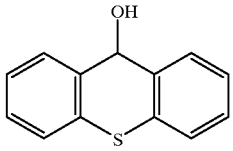
Nb-9
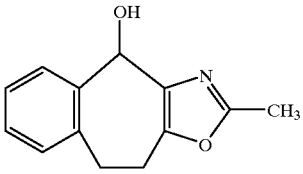
Nb-10
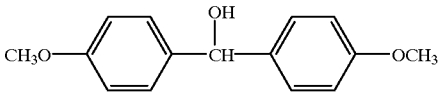
Nb-11
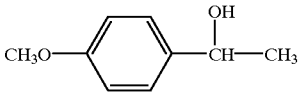

-continued

NB-12

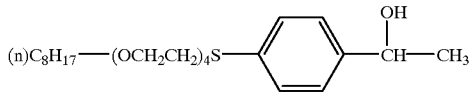

In addition, specific examples of the nucleation accelerating compounds include exemplified Compounds (2-1) through (2-20) disclosed in paragraphs (0062) on Page 13 through (0065) on page 15 in Japanese Patent OPI Publication No. 6-258751(1994) and exemplified Compounds 3-1 to 3-6 disclosed in paragraphs (0067) on page 15 through (0068) on page 16 in JP-A 6-258751.

The nucleation accelerating compounds may be used in any layer located on the side of the silver halide emulsion layer. Preferably the compounds are incorporated either in the silver halide emulsion layer or a layer adjacent thereto. The optimal addition amount may be varied depending on the size, halide composition, degree of chemical ripening of silver halide grains and kind of restraining agent used, however, it is preferably between $10^{-6}$ and $10^{-1}$ mol, and more preferably between $10^{-5}$ and $10^{-2}$ mol per one mol of silver halide.

In an image forming process usable in the invention can be employed a variety of light source. Preferred examples thereof include laser light sources known in the art, such as He-Ne laser and LED. Extremely short exposure of $10^{-6}$ sec or shorter to laser light is preferred. Specifically, outputting with an image-setter is preferred.

In the image forming process relating to the invention, rapid processing is preferred in terms of productivity. In cases when processed in an automatic processor containing a developing tank, the total processing time from the time the top of a photographic material being inserted into the process to the time it comes out of a drying zone (so-called Dry to Dry time) is preferably less than 55 sec. and more preferably less than 40 sec. Furthermore, in the total processing, the time required for development is preferably less than 20 sec., more preferably less than 15 sec., and still more preferably less than 13 sec.

The photographic material used in the invention preferably contains a developing agent in an amount of 0. 2 to 2 g/m$^2$. Examples of the developing agent usable in the invention include dihydroxybenzenes (e.g., hydroquinone, chlorohydroquinone, bromohydroquinone, 2,3-dichlorohydroquinone, methylhydroquinone, isopropylhydroquinone, 2,5-dimethylhydroquinone), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), aminophenols (e.g., o-aminophenol, p-aminophenol, N-methyl-o-aminophenol, N-methyl-p-aminophenol, 2,4-diaminophenol), pyrogallol, erythorbic acid and its salts (e.g., sodium salt, potassium salt), ascorbic acid and its salts (e.g., sodium salt, potassium salt), 1-aryl-3-pyrazolidones {e.g., 1-(p-hydroxyphenyl)-3-aminopyrazolidone, 1-(p-methylaminophenyl)-3-aminopyrazolidone, 1-(p-aminophenyl)-3-aminopyrazolidone, 1-(p-amino-N-methylphenyl)-3-aminopyrazolidone}, transition metal complex salts, which are complex salts of transition metals including Ti, V, Cr, Mn, Fe, Co, Ni, and Cu in the form having reducing power for using as a developer [e.g., complex salts of $Ti^{3+}$, $V^{2+}$, $Cr^{2+}$; and $Fe^{2+}$; and ligands include aminopolycarboxylic acids and their salts such as ethylenediaminetetraacetic acid (EDTA) and diethylenetriamine-pentaacetic acid (DTPA) and phosphoric acids and their salts such as hexametapolyphosphoric acid and tetrapolyphosphoric acid. These developing agents are used alone or in combination thereof. Specifically are preferred a combination of 3-pyrazolidones and dihydroxybenzenes, a combination of aminophenols and dihydroxybenzenes, a combination of 3-pyrazolidones and ascorbic acid, a combination of aminophenols and ascorbic acid, a combination of 3-pyrazolidones and transition metal complex salts, and a combination of aminophenols and transition metal complex salts.

The developing agent-incorporated layer is not specifically limited, but preferably an emulsion layer or a light-insensitive hydrophilic colloidal layer adjacent to the emulsion layer. The developing agent is incorporated more preferably into a light-insensitive hydrophilic colloidal layer adjacent to an emulsion layer is more preferred, and still more preferably a light-insensitive hydrophilic colloidal layer adjacent to an emulsion layer and closer to a support.

Developing agents used for processing photographic materials according to the invention and used in the image forming process relating to the invention are the same as described above.

The silver halide photographic material used in the invention contains light sensitive silver halide. As the light sensitive silver halide can be used any one known in the photographic art, including silver chloride, silver bromide, silver iodobromide, silver chlorobromide and silver iodochlorobromide. Specifically in silver halide photographic material for use in graphic art, silver halide containing 60 mol % or more chloride is preferred. Exemplarily, silver chloride, silver bromochloride containing 60 mol % or more chloride, silver iodobromochloride containing 60 mol % or more chloride, or mixture thereof is preferably used. Halide composition may be homogeneous within the grain or different between internal and external portions, including a core/shell type silver halide grain, in which the halide composition is different between the core and shell, and a multi-layered silver halide grain, in which the halide composition is stepwise or continuously varied within the grain.

The average size of silver halide grains is preferably 0.05 to 0.7 $\mu$m, and more preferably 0.09 to 0.3 $\mu$m. The term "average grain size" has been used commonly in the art. The grain size usually refers to a diameter of the grain in cases where the grain is of spherical shape or in the form close thereto. In the cases where the grain is a cubic shape, it means a diameter of a sphere when the cube is converted into a sphere having the equivalent volume. With regard to the method of obtaining the average diameter, one can refer to the disclosure in C. E. K. Mees and T. H. James, "The theory of the Photographic Process" 3rd Edition, pages 36–43, Mcmillan Co. (1966). There is no limitation as to the shape of the silver halide grain, and any one of tabular, cubic, spherical, tetradecahedral or octahedral shape can optionally be used. Concerning grain size distribution, the narrower, the more preferable. Particularly, so-called monodispersed emulsion, in which more than 90% of the total number of grains fall within the range ±40% around the average grain size, is preferred.

Silver halide emulsions used in the invention can be chemically sensitized using known sensitizers (e.g., active gelatin, sulfur single body, sodium thiosulfate, thiourea dioxide, sodium chloroaurate), Chemical sensitization can be conducted in the presence of a nitrogen-containing heterocyclic compound or mercapto group-containing heterocyclic compound.

Silver halide emulsions can be spectrally sensitized to a desired wavelengths using a sensitizing dye. Representative examples of sensitizing dyes include those described in JP-A 59-180553, 60-140335, 60-263937, 61-65232, 61-153635, 61-153631, 62-32446, 63-61242, 63-138343, 3-163440, 4-31854, 4-34547 and 5-45833. Further, two or more kinds of sensitizing dyes may be used in combination, as described in JP-A 62-39846, 62-86360, 62-89037, 62-147450 and 62-147451. The sensitizing dye is preferably used in an amount of $10^{-5}$ to $10^{-2}$ mol per mol of silver halide. The sensitizing dye may be added at any stage of a silver halide emulsion, and specifically, at the time of forming silver halide grains, desalting, before chemical sensitization, during chemical sensitization or after completing chemical sensitization.

A compound containing a metal such as Rh, Re, Ru, Os or Ir may be occluded in silver halide grains. The metal compound is added in the form of an aqueous soluble complex salt, as described in JP-A 63-2042, 1-285941, 2-20852 and 2-20855. Specifically preferred is a sixcoordinate complex as shown below:

$$[ML_6]^{n-}$$

where M represents Rh, Re, Ru, Os or Ir; L represents a ligand; and n is 0, 1, 2 or 3. A counter ion is optional and ammonium or alkaline metal ions are conventionally employed. Preferred ligands include a halogeno ligand, cyano ligand, cyanato ligand, nitrosyl ligand, and thionirosyl ligand.

The metal complexes are added to an aqueous halide solution, in the form of powder or a solution together with NaCl or KCl, during grain formation. Exemplary preferred metal complexes are shown below:

$[RhCl_6]^{3-}$, $[RhCl_5(H_2O)]^{2-}$, $[RhBr_5(NO)]^{2-}$, $[RhCl_5(NS)]^{2-}$, $[RhCl_4(NO)(CN)]^{-}$, $[RhCl_4(NO)(CN)_1]^{2-}$, $[ReCl_6]^{3-}$, $[ReBr_6]^{3-}$, $[ReCl_5(NO)]^{2-}$, $[Re(NS)Br_3]^{2-}$, $[Re(NO)(CN)_3]^{2-}$, $[RuCl_6]^{3-}$ $[RuCl_4(H_2O)_2]^{-}$, $[RuCl_5(NO)]^{2-}$, $[RuBr_5(NS)]^{2-}$, $[OsCl_6]^{3-}$ $[Os(NO)(CN)_3]^{2-}$ and $[Os(NS)Br_5]^{2-}$.

Of these are preferred Rh containing compounds. The metal compound may be used in combination. The addition amount is preferably $1\times10^{-9}$ to 1×10–5, and more preferably $1\times10^{-8}$ to $1\times10^{-6}$ mol per mol of silver halide.

With respect to the silver amount used as a silver halide emulsion, so far as sufficiently high maximum density is obtained, the less the more preferred in terms of rapid processability and stability. The amount of silver salts, which is represented by equivalents converted to silver, is preferably not more than 3.3 g/m$^2$, and more preferably not more than 3.1 g/m$^2$.

In a silver halide emulsion layer or other hydrophilic colloidal layers, gelatin is advantageously employed as a binder or hydrophilic colloid and other hydrophilic collodal materials may also employed. Examples thereof include gelatin derivatives; graft polymer of gelatin and another polymer; proteins such as albumine or casein; cellulose derivatives such as hydroxyethyl cellulosecarboxymethyl cellulose or cellulose sulfuric acid ester; sodium alginate, saccharide derivatives such as starch derivatives; synthetic hydrophilic polymers such as polyvinyl alcohol or its partial acetals, poly-N-vinylpyrrolidone, polyacrylic acid, polyacrylamide, polyvinyl imidazole orpolyvinyl pyrazole or their coplymers. Gelatin includes lime-processed gelatin, acis-processed gelatin, gelatin hydrolysates and enzymatic process gelatin. A dispersion of water-insoluble or scarecely water soluble synthetic polymer may be incorporated in a silver halide emulsion used in the invention, for example, for improving dimensional stability. Examples of such a polumer include polymers of alkyl (metha)acrylate, alkoxyacryl (metha)acrylate, glycidyl (metha)acrylate, vinyl ester (e.g., vinyl acetate), acrylonitrile, olefins and styrene, or their combination; or copolymers of a monomer described above and a monomer such as acrylic acid, methacrylic acid, α,β-unsaturated dicarboxylic acid, hydroxyalkyl (metha) acrylate, sulfoalkyl (metha)acrylate or styrenesulfonic acid.

Into a silver halide emulsion layer or light-insensitive hydrophilic colloidal layer, organic or inorganic hardeners may be incorporated as a cross0linking agent for hydrophilic colloidal materials such as gelatin. Example thereof include chromium salts (e.g., chrome alum, chromium acetate), aldhydes (e.g., formaldehyde, glyoxal, glutar aldehyde), N-methylol compounds (e.g., dimethylol urea, methylol dimethylhydantoin), dioxane derivatives (e.g., 2,3-dihydroxydioxane), active vinyl compounds {[e.g., 1,3,5-triacryloyl-hexahydros-triazine, bis(vinylsulfonyl)methyl ether, N,N'-methylenebis-[β-(vinylsulfonyl)propioneamide]}, active halogen compounds (e.g., 2,4-dichloro-6-hydroxy-s-triazine), mucohalogen acids (e.g., mucochloric acid, phenoxymucochloric acid), isooxazoles, dialdehyde starch, 2-chloro-6-hydroxytriazinyl gelatin, carboxy group-activating type hardener. These hardeners can be used singly or in combination. The hardeners are described in Research Disclosure Vol. 176, 17643 (December, 1978) page 26, sect. A–C.

A variety of additives are employed in photographic materials used in the invention, including desensitizers, plasicizers, lubricants, development accelerating agents and oil.

Spports used in the invention may be transparent or opaque and a transparent plastic support is preferred. Olastic supports include polyethylenes (e.g., polyethylene terephthalate, polyethylene naphthalate), triacetates (e.g., triacetate cellulose) and polystyrenes (e.g., syndiotactic polystyrene). The thickness of the support is preferably 50 to 250 m, and more preferably 70 to 200 μm.

In this image forming process, it is preferred to optimally control the developing temperature. Heating can be conducted by bringing the processing solution or photographic material into contact with a heated block or plate, or with a heating board, hot-press, heated roller, halogen lamp heater, or infrared or far infrared lamp heater. The processing temperature is preferably within the range of 30 to 55° C., more preferably 34 to 50° C., and still more preferably 37 to 45° C.

In the present invention, known materials and techniques used in photographic materials and image forming processes are also applicable, and specifically, known materials and techniques relating to black-and-white photographic materials and processing methods thereof are preferable.

A silver halide black-and-white photographic material for graphic arts, used in the invention is processed preferably with a developer containing a compound represented by the following formula (A):

$R_1$—CH(OH)—C(=O)—$(X)_k$—$R_2$ formula (A)

wherein $R_1$ and $R_2$ independently represent a unsubstituted or substituted alkyl group, unsubstituted or substituted alkoxy group, unsubstituted or substituted alkylthio group or unsubstituted or substituted amino group, provided that $R_1$ and $R_2$ may combine with each other to form a ring; k is 0 or 1; and when k is 1, X represents —CO— or —CS—.

The developer used in the invention preferably contains substantially no dihydroxybenzene. Furthermore, the developer preferably contains an auxiliary developing agent which exhibits superadditivity, together with a developing agent of the formula (A) described above. The developer preferably contains –0.35 mol/$m^2$ or more of a carbonate salt, as a buffer.

In place of the afore-mentioned formula [A], a compound represented by the following formula [A-a] may be usable.

Formula [A-a]

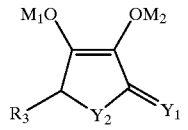

wherein $R_3$ represents a hydrogen atom, an alkyl group, aryl group, amino group or an alkoxy group, which may be substituted, a sulfo group, a carboxy group, an amide group, a sulfonamide group; $Y_1$ represents O or S; $Y_2$ represents O, S or $NR_4$, in which $R_4$ a substituted or unsubstituted alkyl or aryl group; $M_1$ and $M_2$ each represent a hydrogen atom or an alkaline metal.

In formulas [A] and [A-a], an alkyl group is preferably a lower alkyl having 1 to 5 carbon atoms; as an amino group, is preferable an unsubstituted amino group or a amino substituted by a lower alkyl group; as an alkoxy group, is preferable a lower alkoxy group; as an aryl group, is preferable phenyl or naphthyl, each of which may be substituted by hydroxy, a halogen atom, a sulfo group, a carboxy group, am amide or an suofonamide group.

Compounds represented by formular [A] or [A-a] are exemplified as bellows, but the present invention is not limited thereto.

Examples of formula [A]

| Compound No. | X | | $R_1$ | $R_2$ |
|---|---|---|---|---|
| A-1 | — | (k = 0) | $HOCH_2CH(OH)—CH(OH)—$ | —OH |
| A-2 | — | (k = 0) | $CH_3CH(OH)—CH(OH)—$ | —OH |
| A-3 | — | (k = 0) | $HOCH_2CH(OH)—CH(OH)—$ | $—CH_3$ |
| A-4 | — | (k = 0) | $CH_3CH(OH)—CH(OH)—$ | $—CH_3$ |
| A-5 | —C(=O)— | (k = 1) | $HOCH_2CH(OH)—CH(OH)—$ | —OH |
| A-6 | —C(=O)— | (k = 1) | $CH_3CH(OH)—CH(OH)—$ | —OH |
| A-7 | —C(=S)— | (k = 1) | $HOCH_2CH(OH)—CH(OH)—$ | —OH |
| A-8 | —C(=S)— | (k = 1) | $CH_3CH(OH)—CH(OH)—$ | —OH |
| A-9 | —C(=O)— | (k = 1) | $HO—CH_2—$ | —OH |
| A-10 | —C(=O)— | (k = 1) | $HO—CH_2—$ | $—CH_2$ |

-continued

| | | | | |
|---|---|---|---|---|
| A-11 | $-\overset{\overset{O}{\|\|}}{C}-$ | (k = 1) | HO—$CH_2$— | —$C_2H_5$ |
| A-12 | $-\overset{\overset{O}{\|\|}}{C}-$ | (k = 1) | HO—$CH_2$— | —$C_2H_4OH$ |

Examples of formula [A-a]

| Compound No. | $Y_1$ | $Y_2$ | $R_3$ | Compound No. | $Y_1$ | $Y_2$ | $R_3$ |
|---|---|---|---|---|---|---|---|
| A-13 | 0 | 0 | H | A-22 | S | 0 | $HOCH_2\underset{\underset{OH}{\|}}{CH}-$ |
| A-14 | 0 | 0 | $CH_3$ | A-23 | 0 | N | H |
| A-15 | 0 | 0 | $\underset{\underset{OH}{\|}}{CH_2}$ | A-24 | 0 | N | $HOCH_2\underset{\underset{OH}{\|}}{CH}-$ |
| A-16 | 0 | 0 | $CH_3\underset{\underset{OH}{\|}}{CH}-$ | A-25 | 0 | S | H |
| A-17 | 0 | 0 | $HOCH_2\underset{\underset{OH}{\|}}{CH}-$ | A-26 | 0 | S | $HOCH_2\underset{\underset{OH}{\|}}{CH}-$ |
| A-18 | 0 | 0 | $ClCH_2\underset{\underset{OH}{\|}}{CH}-$ | A-27 | 0 | S | $CH_3\underset{\underset{OH}{\|}}{CH}-$ |
| A-19 | 0 | 0 | $HOOCCH_2\underset{\underset{OH}{\|}}{CH}-$ | A-28 | S | S | H |
| A-20 | S | 0 | H | A-29 | S | S | $HOCH_2\underset{\underset{OH}{\|}}{CH}-$ |
| A-21 | S | 0 | $CH_3\underset{\underset{OH}{\|}}{CH}-$ | A-30 | S | S | H |

| Compound No. | $Y_1$ | $Y_2$ | $R_3$ | $M_1$ | $M_2$ |
|---|---|---|---|---|---|
| A-31 | 0 | 0 | $HOCH_2\underset{\underset{OH}{\|}}{CH}-$ | Na | H |
| A-32 | 0 | 0 | $HOOCCH_2\underset{\underset{OH}{\|}}{CH}-$ | H | Na |
| A-33 | S | 0 | H | Na | H |
| A-34 | 0 | NH | $HOCH_2\underset{\underset{OH}{\|}}{CH}-$ | H | K |

A compound represented by formula [A] is containd in an amount of 0.05 to 5, preferably 0.1 to 1.0 mol per liter of a developer. These compounds, which are typical ones derived from an ascorbic acid or isoascorbic acid are commercially available and can be easily synthesyzed in a well known method.

As an auxiliary developing agent displaying supperadditivity in combination with a compound represent by formula [A], are cited 3-pyrazolidone derivative and p-aminophenol derivative. These compounds have been known as a auxiliary developing agent. The following compounds are exemplified, which are not limited thereto.

1-Phenyl-3-pyrazolidone

1-Phenyl-4,4-dimethyl-3-pyrazolidone 1-phenyl-4-methyl-4-hydroxymethyl-3-pyrazolidone 1-pheny-5-methyl-3-pyrazolidone 1-p-Aminophenyl-4,4-dimethyl-3-pyrazolidone 1-p-Tolyl-4,4-dimethyl 3-pyrazolidone 1-p-Tolyl-4-methyl-4-hydroxymethyl-3-pyrazolidone N-Methyl-p-aminophenol N-(β-Hydroxyethyl)-p-aminophenol N-(4-Hydroxyphenylglycine 2-Methyl-p-aminophenol p-Benzylaminophenol A compound represented by formula [A] or [A-a] is contained in an amount of 0.001 to 0.05, preferably, 0.0035 to 0.035, more preferably, 0.005 to 0.01 mol per liter of a developer. Among compounds as above-described, a 3-pyrazolidone compound is preferable.

A developer of the invention does not substantilly contain a dihydroxybenzene developing agent. The dihydroxybenzene developing agent as herein described is a compound represented by the following formulas [V-1] to [V-3].

Formula [V-1]

formula [V-1]

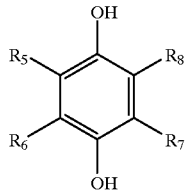

formula [V-2]

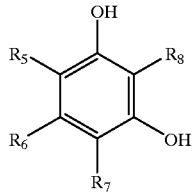

formula [V-3]

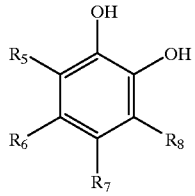

wherein $R_5$, $R_6$, $R_7$ and $R_8$ independently represent a hydrogen atom, an alkyl group, an aryl group, a carboxy group, a halogen atom or a sulfo group.

As examples thereof, are cited hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Among them, hydroquinone is representative one.

In the invention, any dihydroxybenzene(s) is not substantially contained. The word 'not substantilly contained" means that dihydroxybenzene is not absolutely contained or it is contained in a slight amount not so as to display a developing effect. Thus, dihydroxybenzene is contained in an amount of not more than 5 mol % of a compound of formula [A] or not more than 0.03 mol/liter. More preferably, no dihydroxybenzene is contained.

In the present invention, a carbonate salt, as a buffer agentis contained in a developer. As examples of carbontes, are cited sodium carbonate, potassium carbonate, lithium carbonate and ammonium carbonate; preferably, sodium carbonate and potassium carbonate. The carbonate is contained in an amount of 0.35 mol/l or more; preferably, 0.5 to 1.5 mol/l; more preferably, 0.8 to 1.3 mol/l.

Next, there will be described application of the present invention to thermally processable photographic materials. The thermally processable photographic material comprises a support having thereon one or more photographic component layer(s), and at least one of the photographic component layer(s) containing a organic silver salt, light sensitive silver halide grains and a reducing agent. These materials may be contained together in one layer or separately in plural layers.

The lanthanoid triflate compound used in the invention can be contained in at least a photographic component layer, and preferably in a layer containing silver halide grains. The lanthanoid triflate compound may be contained in a light-insensitive hydrophilic collidal layer or light-insensitive hudrophobic binder layer.

The photographic component laye preferably contains a hydrazine compound afore-mentioned. The silver halide grains are the same as those afore-mentioned.

The organic silver salts used in a thermally processable photographic material are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocylic rings. Organic or inorganic silver salt complexes are also useful in which the ligand has a total stability constant for silver ion of 4.0 to 10.0.

Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides.

Of these, the preferred silver salt is silver behenate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc.

In the present invention, organic silver salts have an average grain diameter of 1 μm and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 μm, and is most preferably between 0.05 and 0.5 μm. Furthermore, the monodisperse as described herein is the same as silver halide grains and preferred monodispersibility is between 1 and 30 percent. In the present invention, the organic silver salts are preferably composed of monodispersed grains with an average diameter of not more than 1 μm. When grains are prepared within this range, high density images can be obtained.

In the present invention, the total amount of silver halides and organic silver salts is preferably between 0.3 and 2.5 g per $m^2$ in terms of silver amount. When these are prepared within this range, high contrast images can be obtained. Furthermore, the amount of silver halides to that of total silver is not more than 50 percent by weight; is preferably not more than 25 percent, and is more preferably between 0.1 and 15 percent.

A reducing agent is preferably incorporated into the thermally processable photographic material to which the present invention is applied. Examples of suitable reducing agents are described in U.S. Pat. Nos. 3,770,448, 3,773,512, and 3,593,863, and Research Disclosure Items 17029 and 29963, and include the following:

Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones.

Of these, particularly preferred reducing agents are hindered phenols. As hindered phenols, listed are compounds represented by the general formula (A) described below:

General Formula (A)

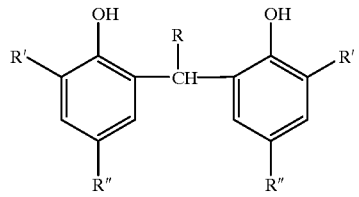

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

A-1

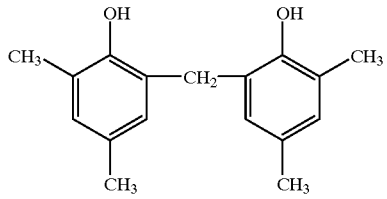

A-2

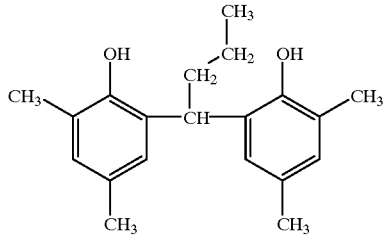

A-3

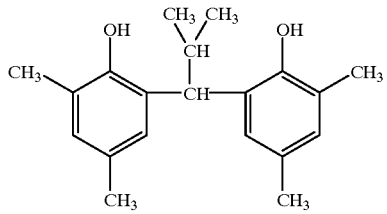

A-4

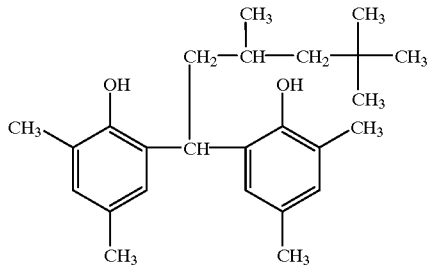

-continued

A-5

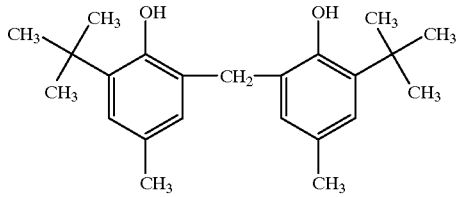

A-6

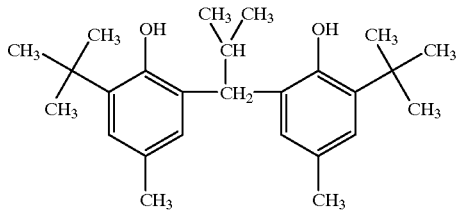

A-7

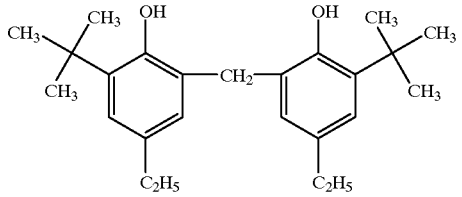

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally processable photographic material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal) and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic.

In the present invention, with the purpose of minimizing the size variation after thermal development, the amount of the binder in a photosensitive layer is preferably between 1.5 and 10 g/m$^2$, and is more preferably between 1.7 and 8 g/m$^2$. When the amount is below 1.5 g/m$^2$, the density of an unexposed part markedly increases to occasionally cause no commercial viability.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 10 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc.

Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed.

The size of a matting agent is expressed in the diameter of a sphere which has the same volume as the matting agent. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of grain diameter)/(average grain diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Addition methods of the matting agent according to the present invention include those in which a matting agent is previously dispersed into a coating composition and is then coated, and prior to the completion of drying, a matting agent is sprayed. When a plurality of matting agents are added, both methods may be employed in combination.

The thermally processable photographic material, to which the present invention is applied, is subjected to formation of photographic images employing thermal development processing and preferably comprises a reducible silver source (organic silver salt), silver halide with an catalytically active amount, a hydrazine derivative, a reducing agent and, if desired, an image color control agent, to adjust silver tone, which are generally dispersed into a (organic) binder matrix.

The thermally processable photographic material, to which the present invention is applied, is stable at normal temperatures and is developed, after exposure, when heated to not less than 250° C. Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally processable photographic material, to which the present invention is applied, comprises a support having thereon at least one photosensitive layer, and the photosensitive layer may only be formed on the support. Further, at least one nonphotosensitive layer is preferably formed on the photosensitive layer. In order to control the amount or wavelength distribution of light transmitted through the photosensitive layer, a filter layer may be provided on the same side as the photosensitive layer, or on the opposite side. Dyes or pigments may also be incorporated into the photosensitive layer. As the dyes, preferred are compounds described in Japanese Patent Application No. 7-11184. The photosensitive layer may be composed of a plurality of layers. Furthermore, for gradation adjustment, in terms of sensitivity, layers may be constituted in such a manner as a fast layer/slow layer or a slow layer/fast layer. Various types of additives may be incorporated into any of a photosensitive layer, a nonphotosensitive layer, or other formed layers.

Surface active agents, antioxidants, stabilizers, plasticizers, UV absorbers, covering aids, etc. may be employed in the thermally processable photographic material to which the present invention is applied.

Image color control agents are preferably incorporated into the thermally processable photographic material to which the present invention is applied. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis(isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

Antifoggants may be incorporated into the thermally processable photographic material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers [0062] and [0063] of Japanese Patent Publication Open to Public Inspection No. 9-90550.

Furthermore, more suitable antifoggants are disclosed in U.S. Pat. No. 5,028,523, and U.K. Patent Application Nos. 92221383. No. 4, 9300147. No. 7, and 9311790. No. 1.

In the thermally processable photographic material to which the present invention is applied, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679.

Supports employed in the present invention are preferably, in order to obtain predetermined optical density after development processing and to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics (hereinafter referred to as SPS) comprising styrene series polymers having a syndiotactic structure. The thickness of the support is between about 50 and about 300 $\mu$m, and is preferably between 70 and 180 $\mu$m.

Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point by not less than 30° C. and more preferably by at least 40° C. However, when the supports are heated at a temperature higher than the melting point, no advantages of the present invention are obtained.

Plastics employed in the present invention are described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in Japanese Patent Publication Open to Public Inspection No. 3-131843.

As the base casting method of the support and subbing production method which are associated with the present invention, any of those known in the art can be employed. However, those methods described in paragraphs [0030] through [0070] of Japanese Patent Publication Open to Public Inspection No. 9-50094 are preferably employed.

EXAMPLES

Embodiments of the present invention will be further explained, based on examples; however, the invention is not limited to these examples.

Example 1

Preparation of Support (Subbing of Support)

On a polyethylene terephthalate (PET) film base of 100 μm thick was coated a latex solution mainly containing a subbing latex (20% of solid component) and dries to form a sublayer of 0.5 μm thick. Prior to coating, the sublayer side of the support was subjected to corona discharge. Provided thereon was a 0.3 μm thick adhesive layer comprised of styrene-butadiene, styrene-glycidylacrylate and gelatin. Further formed thereon was a 0.2 μm thick polymer layer containing fine semiconductor particle mixture comprised of stannic oxide particles of an average size of 0.1 μm and barium sulfate. There was thus prepared a PET film with antistatic property.

Preparation of Inventive Silver Halide Emulsion 1

Silver bromochloride core grains containing 70 mol % chloride of an average grain size of 0.11 μm was prepared by the double jet method. Thus, an aqueous silver nitrate solution and an aqueous halide solution were simultaneously added in the presence of 80 μg $K_3Rh(NO)_4(H_2O)_2$ per mol of total silver , while the pH and silver potential (EAg) were maintained at 3.0 and 165 mV, respectively, at a temperature of 50° C. After the EAg was lowered to 125 mV with sodium chloride, core grains were shelled by the double jet method, in which 20 μg/mol Ag of $K_3RhCl_6$, 100 μg/mol Ag of $K_3IrCl_6$ and 10 mg/mol Ag of $(CF_3SO_3)_3Yb$ were added to a halide solution. After completing addition were further added fine silver iodide grains. The resulting emulsion was comprised of monodisperse core/shell type silver iodobromochloride cubic grains containing 70 mol % chloride and 0.2 mol % iodide and having an average size of 0.18 μm and variation coefficient of 10%.

Preparation of Comparative Silver Halide Emulsion 2

Silver bromochloride core grains containing 70 mol % chloride of an average grain size of 0.11 μm was prepared by the double jet method. Thus, an aqueous silver nitrate solution and an aqueous halide solution were simultaneously added in the presence of 80 μg $K_3Rh(NO)_4(H_2O)_2$ per mol of total silver , while the pH and silver potential (EAg) were maintained at 3.0 and 165 mV, respectively, at a temperature of 50° C. After the EAg was lowered to 125 mV with sodium chloride, core grains were shelled by the double jet method, in which 20 μg/mol Ag of $K_3RhCl_6$ and 100 μg/mol Ag of $K_3IrCl_6$ were added to a halide solution. After completing addition were further added fine silver iodide grains. The resulting emulsion was comprised of monodisperse core/shell type silver iodobromochloride cubic grains containing 70 mol % chloride and 0.2 mol % iodide and having an average size of 0.18 μm and variation coefficient of 10%.

The thus prepared emulsions were each desalted using modified gelatin (in which amino groups contained in gelatin were substituted with phenylcarbamyl), e.g., compound G-8, as described in JP-A 2-280139. After desalting, the EAg was 190 mV at 50° C.

To each of the emulsions were added 100 mg/mol Ag of potassium bromide and citric acid to adjust the pH and EAg to 5.6 and 123 mV and then 170 mg/mol Ag of sodium p-toluene-sulfonylchloroamide trihydrate (Chloramine T) was further added thereto. Subsequently 0.6 mg/mol Ag of sulfur simple substance ($S_8$), PM-1200 in the form of solid particles of an average size of 0.5 μm and dispersed with saponin, which was available from Seishin Kigyo Co.) and 6 mg of chloroauric acid were added and chemically ripened at a temperature of 55° C. until reaching the maximum speed. Then, 300 mg of sensitizing dye SD-660 was added, and 600 mg/mol Ag of 4-hydroxy-6-methyl-1,3,3a,7-tetrazaindene, 20 mg/mol Ag of 1-phenyl-5-mercaptotetrazole and 300 mg/mol Ag were added and the pH was adjusted to 5.1 with citric acid.

Preparation of Silver Halide Photographic Material

On the described support opposite to an antistatic layer side were coated a gelatin sublayer (Formula 1) in a gelatin amount of 0.55 g/m$^2$, a silver halide emulsion layer (Formula 2) in a silver amount of 3.3 g/m$^2$ and a gelatin amount of 1 g/m$^2$ and a protective layer (Formula 3) in a gelatin amount of 0.6 g/m$^2$ in this order; and, on the side opposite to the emulsion layer were coated a backing layer (Formula 4) in a gelatin amount of 1.5 g/m$^2$ and a backing protective layer (Formula 5) in a gelatin amount of 0.8 g/m$^2$. The layers on the emulsion-side were simultaneously coated by the curtain coating method at a coating speed of 200 m/min. and set with cooling, subsequently, the layers on the backing layer-side were simultaneously coated and cooled to −1° C. to be set, and both sides were dried to obtain photographic material Samples 1 to 4, as shown in Table 2.

| Formula 1 (Gelatin sublayer) | |
|---|---|
| Gelatin | 0.55 g/m$^2$ |
| 1-Phenyl-5-mercaptotetrazole | 2.0 g/m$^2$ |
| Fungicide Z | 0.5 g/m$^2$ |
| Dye 1-25 (solid particle dispersion) | 30 g/m$^2$ |
| **Formula 2 (Silver halide emulsion layer)** | |
| Silver halide emulsion | 3.3 g silver-eq./m$^2$ |
| Gelatin | 1 g/m$^2$ |
| Hydrazine compound H 1, in an amount as shown in Table 2 | |
| Amine compound Na-21 | 13 mg/m$^2$ |
| SA (sodium isoamyl-n-decylsulfosuccinate) | 1.7 mg/m$^2$ |
| 2-mercaptohypoxanthine | 2 mg/m$^2$ |
| Nicotinic acid amide | 1 mg/m$^2$ |
| n-Propyl gallate | 50 mg/m$^2$ |
| Mercaptopyrimidine | 1 mg/m$^2$ |

-continued

| | |
|---|---|
| EDTA | 50 mg/m$^2$ |
| Polymer latex L1 | 0.25 mg/m$^2$ |
| Polymer latex L6 | 1.0 mg/m$^2$ |
| Dye k | 10 mg/m$^2$ |

Phthalated gelatin was used and the pH of a coating solution was 4.8.

Formula 3 (Emulsion-protective layer)

| | |
|---|---|
| Gelatin | 0.6 g/m$^2$ |
| SA | 12 mg/m$^2$ |
| Matting agent (Spherical polymethyl methacrylate particles of av., size of 3.5 $\mu$m) | 15 mg/m$^2$ |
| Dextrin (product by Meito Sangyo Corp.) in amount as shown in Table 2 | |
| Amorphous silica (av. size 8 $\mu$m) | 13 mg/m$^2$ |
| Surfactant S1 | 30 mg/m$^2$ |
| Lubricant (silicone oil) | 10 mg/m$^2$ |
| Compound a | 50 mg/m$^2$ |
| Polymer latex L6 | 0.3 mg/m$^2$ |
| 1,3-Vinylsulfonyl-2-propanol | 40 mg/m$^2$ |
| Hardener h4 | 60 mg/m$^2$ |
| Sodium polystyrenesulfonate | 10 mg/m$^2$ |
| Fungicide Z | 0.5 mg/m$^2$ |
| 2-Mercaptohypoxanthine | 30 mg/m$^2$ |

-continued

Formula 4 (Backing layer)

| | |
|---|---|
| Gelatin | 1.5 g/m$^2$ |
| Surfactant S1 | 5 mg/m$^2$ |
| Polymer latex L3 | 0.3 g/m$^2$ |
| Colloidal silica (av. size 0.05 $\mu$m) | 100 mg/m$^2$ |
| Sodium polystyrenesulfonate | 10 mg/m$^2$ |
| Dye f1 | 65 mg/m$^2$ |
| Dye f2 | 15 mg/m$^2$ |
| Dye f3 | 100 mg/m$^2$ |
| 1-Phenyl-5-mercaptotetrazole | 10 mg/m$^2$ |
| Hardener h3 | 100 mg/m$^2$ |
| Zinc hydroxide | 50 mg/m$^2$ |
| EDTA | 50 mg/m$^2$ |

Formula 5 (Backing-protective layer)

| | |
|---|---|
| Gelatin | 0.8 mg/m$^2$ |
| Matting agent (Spherical polymethyl methacrylate particles of av., size of 5 $\mu$m) | 50 mg/m$^2$ |
| Amorphous silica (av. size 3 $\mu$m) | 12.5 mg/m$^2$ |
| Sodium di-(2-ethylhexyl)-sulfosuccinate | 10 mg/m$^2$ |
| Surfactant S1 | 1 mg/m$^2$ |
| Dye f1 | 65 mg/m$^2$ |
| Dye f2 | 15 mg/m$^2$ |
| Dye f3 | 100 mg/m$^2$ |
| Compound a | 50 mg/m$^2$ |
| Hardener h2 | 20 mg/m$^2$ |
| Sodium polystyrenesulfonate | 10 mg/m$^2$ |

Fungicide Z

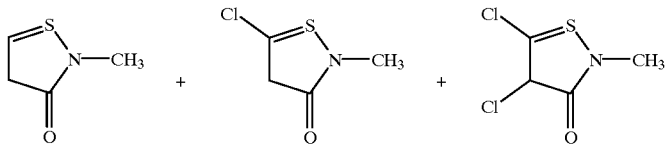

Sensitizing dye SD-660

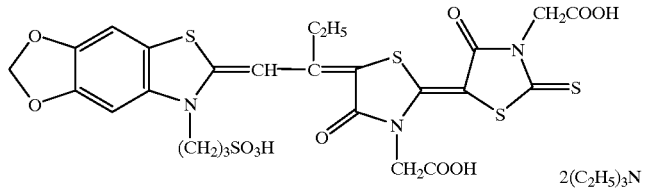

Compound a

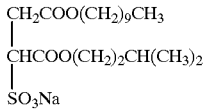

Polymer latex L1

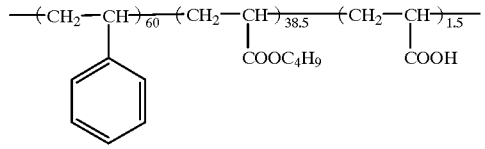

-continued
Hardener h2
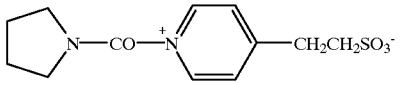
Surfactant S1
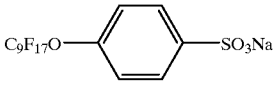
Polymer latex L3
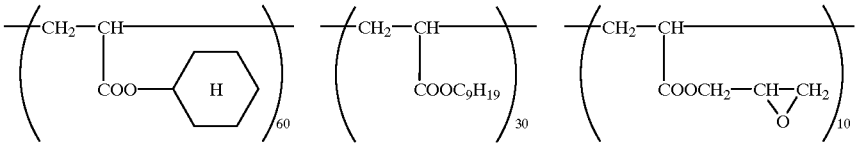
Dye f1
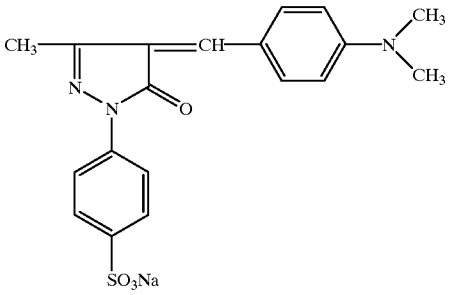
Dye f2
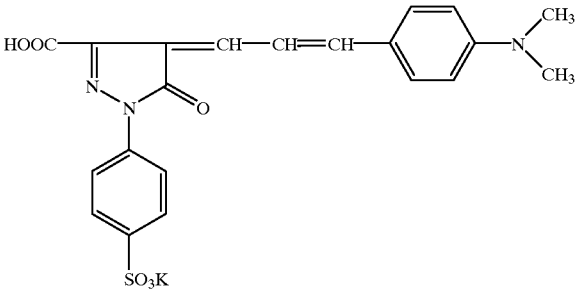
Dye f3
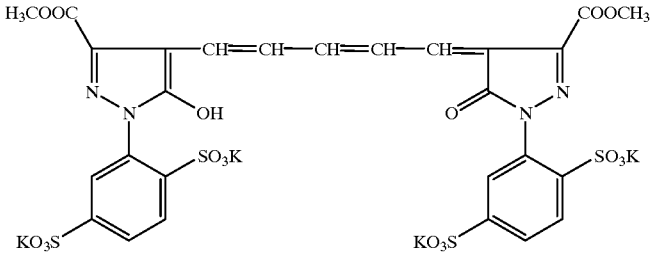
Hardener h3
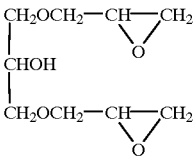

-continued

Polymer latex L6

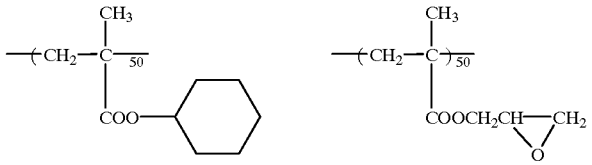

Dye 1-25 (Solid particle dispersion)

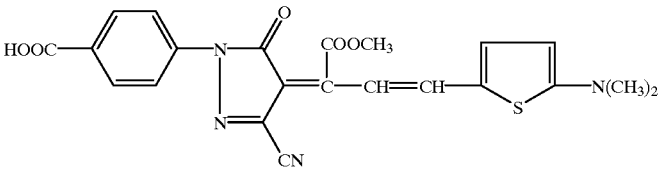

Dye K

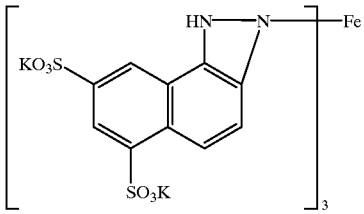

H1

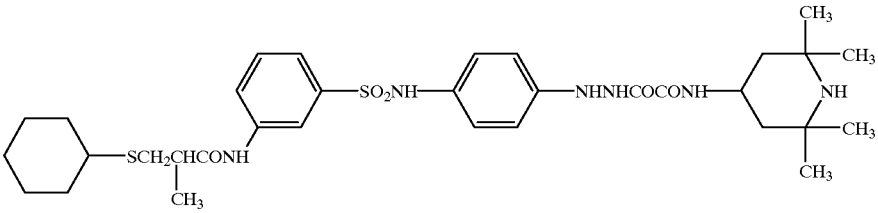

Hardener h4

$(CH_2{=}CHSO_2CH_2CONHCH_2)_2$

Na-21

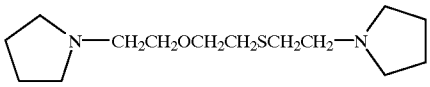

Preparation of developer

Preparation of solid developer composition (Preparation of Solid Developer Kit, corresponding to 10 l worker)

Pre-treatment of Materials

Hydroquinone was pulverized using MIKRO-PULVERIZER AP-B (available from Hosokawa Mikron Co.) with a mesh of 8 mm and rotating at 50 Hz. 8-Mercaptoadenine was pulverized using the above-described pulverizer with a mesh of 8 mm and rotating at 50 Hz. KBr was pulverized using the above-described pulverizer with a mesh of 8 mm and rotating at 50 Hz.

Mixing of Materials

Using a commercially available V-type mixer (Volume of 200 lit.), material as shown below was mixed for a period of 10 min.

| | |
|---|---|
| Hydroquinone | 65 kg |
| Elbit N (available from Fujisawa Yakuhin) | 16 kg |

-continued

| | |
|---|---|
| Dimezone S | 3.5 kg |
| 8-Mercaptoadenine (pulverized as above) | 0.3 kg |
| DTPA. 5H | 11 kg |
| KBr (pulverized as above) | 6.5 kg |
| Sorvitol | 5 kg |

From arbitrary points (five points) of the thus-obtained mixture, each 50 g was sampled and analyzed. As a result, the concentration of each component was within +5% of the above formula value and the mixture was proved to be uniformly mixed.

Molding

The above mixture was molded using a compressing glanulator, Briquetter BSS Type IV (produced by Shinto Kogyo Co.) at a pocket form of 5.0 mmø×1.2 mm (Depth), a roller rotation speed of 20 rpm and a feeder rotation speed of 50 rpm. Thus molded planar material was crushed with a classifier and classified into ggranules of 2.4 to 7.0 mm and fine powder of less than 2.4 mm (provided that granules of more than 7 mm was further crushed). The fine powder of less than 2.4 mm was mixed with the above mixture and molded again using a compression molding machine.

Starting Materials

The following starting materials were treated in accordance with the procedure described below. Mixing of sodium sulfite, 1-phenyl-5-mercaptotetrazole and benzotriazole In 400 ml of ethyl alcohol were dissolved 18 g of 1-phenyl-5-mercaptotetrazole and 78 g of benzotriazole. The resulting solution was dropwise added to 20 kg of sodium sulfite with stirring with a mixer, and stirring further continued until completely dried. From arbitrary portions (five portions) of the thus-obtained mixture, each 50 g was sampled and analyzed. As a result, 1-phenyl-5-mercaptotetrazole and benzotriazole were proved to be uniformly mixed. The mixture was denoted as M-1. Mixing of potassium carbonate, sodium carbonate anhydride and lithium hydroxide monohydrate Using a commercially available V-type mixer (Volume 200 lit.), 56 kg of potassium carbonate, 42 kg of sodium carbonate and 22 kg of lithium hydroxide monohydrate were mixed for a period of 10 min. The resulting mixture was denoted as M-2. Package (kit for 10 lit. worker solution)

Starting material mixture and molded materials were filled in a standing pouch form, in the following order and sealed using a heat sealer.

Mixture M-2 600 g (Lower layer)

Mixture M-1 663.2 g (Intermediate layer)

Granule DA 399 g (Upper layer)

This kit was dissolved in 10 lit. of water.

Preparation of fixer

Preparation of solid fixer composition (Preparation of Solid Fixer Kit, corresponding to 10 l worker)

Pre-treatment of Materials

Sodium 1-octanesulfonate was pulverized using MIKRO-PULVERIZER AP-B (available from Hosokawa Mikron Co.) with a mesh of 4 mm and rotating at 60 Hz.

Mixing of Materials

Using a commercially available V-type mixer (Volume of 200 lit.), material as shown below was mixed for a period of 10 min.

| | |
|---|---|
| Ammonium thiosulfate (10% sodium salt) | 91 kg |
| Sodium metabisulfite | 9.75 kg |

To the mixture, 1 kg of sodium 1-octanesulfonate (pulverized as above) was added and further mixed for a period of 5 min.

Molding

The above mixture was molded using a compressing granulator, Briquetter BSS Type IV (produced by Shinto Kogyo Co.) at a pocket form of 5.0 mmø×1.2 mm (Depth), a roller rotation speed of 30 rpm and a feeder rotation speed of 67 rpm. Thus molded planar material was crushed with a classifier and classified into granules of 2.4 to 7.0 mm and fine powder of less than 2.4 mm (provided that granules of more than 7 mm was further crushed). The fine powder of less than 2.4 mm was mixed with the above mixture and molded again using a compression molding machine. About 95 kg of granule FA was obtained.

Mixing of Materials

Using a commercially available V-type mixer (200 lit. Volume), the following materials were mixed for a period of 10 min.

| | |
|---|---|
| Sodium acetate anhydride | 80 kg |
| Dehydrated aluminum sulfate | 19 kg |
| Succinic acid | 2 kg |
| Sodium gluconate | 1 kg |

Molding

The above mixture was molded using a compressing granulator, Briquetter BSS Type IV (produced by Shito Kogyo Co.) at a pocket form of 5.0 mmø×1.2 mm (Depth), a roller rotation speed of 30 rpm and a feeder rotation speed of 67 rpm. Thus molded planar material was crushed with a classifier and classified into granules of 2.4 to 7.0 mm and fine powder of less than 2.4 mm (provided that granules of more than 7 mm was further crushed). The fine powder of less than 2.4 mm was mixed with the above mixture and molded again using a compression molding machine. About 95 kg of granule FB was obtained.

Package

Molded materials were filled in a standing pouch form, in the following order.

Granule FB 620 g (Lower layer)

Granule FA 1610 g (Upper layer)

This kit was dissolved in 10 lit. of water. The pH was adjusted to 4.70 with an aqueous 50% sulfuric acid solution and an aqueous NaOH solution.

Samples 1 to 4 were exposed through stepped wedge for 1.5×10−7 sec. using a laser sensitometer of 660 nm laser light source and processed using an automatic processor, according to the following conditions.

There is shown in Table 1 humidity dependence of the surface resistivity of the backing layer side at 23° C., before or after processing.

TABLE 1

| Humidity (%) | Before Processing | After Processing |
|---|---|---|
| 10 | $5 \times 10^{11}$ | $8 \times 10^{11}$ |
| 20 | $2.5 \times 10^{11}$ | $4 \times 10^{11}$ |
| 30 | $5 \times 10^{10}$ | $1.6 \times 10^{11}$ |
| 40 | $1.6 \times 10^{10}$ | $4 \times 10^{10}$ |
| 50 | $4 \times 10^{9}$ | $1 \times 10^{10}$ |
| 60 | $1 \times 10^{9}$ | $2.5 \times 10^{9}$ |
| 70 | $4 \times 10^{7}$ | $4 \times 10^{8}$ |
| 80 | $2 \times 10^{6}$ | $7.9 \times 10^{7}$ |

| | Temperature | Time |
|---|---|---|
| Developing | 38° C. | 12 sec. |
| Fixing | 35° C. | 12 sec. |
| Washing | 25° C. | 11 sec. |
| Drying | 49° C. | 11 sec. |

Processed samples each were evaluated according to following manner.

(1) Sensitivity, Fog and Maximum Density

Processed samples were subjected to sensitometry using densitometer PDA-65 (Konica Digital Densitometer). Sensitivity were shown as a relative value at a density of 2.0, based on the sensitivity of Sample 2 being 100, as shown in Table 2. The fog density (Dmin) and maximum density (Dm) were also determined by PDA-65.

(2) Pepper Fog

Processed samples each were also visually observed by 100 times magnifier and the number of pepper fog were counted within the visual field of the magnifier. The less, the better quality. Thus, from the number of pepper fog, it was evaluated, based on the following criteria:

5; No pepper fog observed (excellent level),

4; 1 to 5 pepper fog observed,

3; 6 to 20 pepper fog observed,

2; 21 to 50 pepper fog observed and

1; more than 50 pepper fog observed (poor level).

(3) Processing Stain

Samples were processed in an amount of 100 m2 by the processor, and the level of stains produced in the drying zone of the processor were visually evaluated, based on five ranks, in which rank 5 was the excellent level, rank 3 was the minimum level acceptable to practice and rank 2 or less was a level having problems in practice.

Results thereof are shown in Table 2.

TABLE 2

| Sample No. | Emulsion Layer: Emulsion | Emulsion Layer: Hydrazine H1 (mg/m$^2$) | Protective Layer Dextrin (mg/m$^2$) | Sensitivity | Fog | Dm | Pepper Fog | Stain | Remark |
|---|---|---|---|---|---|---|---|---|---|
| 1 | 2 | 20 | 50 | 60 | 0.02 | 4.2 | 4 | 4 | Comp. |
| 2 | 2 | 40 | 50 | 100 | 0.06 | 4.95 | 1 | 3 | Comp. |
| 3 | 2 | 20 | 200 | 90 | 0.03 | 4.8 | 3 | 1 | Comp. |
| 4 | 1 | 20 | 20 | 100 | 0.02 | 5.1 | 5 | 5 | Inv. |

As can be seen from Table 2, photographic materials according to the invention exhibited sufficient speed and maximum density, and superior image quality, even when subjected to rapid processing.

Example 2

Photographic material samples 5 to 8 were prepared in a manner similar to Example 1, as shown in Table 3, provided that silver halide emulsions were prepared in the following manner. Evaluation results are also shown in Table 3.

Preparation of inventive silver halide emulsion 3

Silver bromochloride core grains containing 70 mol % chloride of an average grain size of 0.11 $\mu$m was prepared by the double jet method. Thus, an aqueous silver nitrate solution and an aqueous halide solution were simultaneously added in the presence of 20 $\mu$g $K_3Rh(NO)_4(H_2O)_2$ per mol of total silver , while the pH and silver potential (EAg) were maintained at 3.0 and 165 mV, respectively, at a temperature of 50° C. After the EAg was lowered to 125 mV with sodium chloride, core grains were shelled by the double jet method, in which 6 $\mu$g/mol Ag of $K_3RhCl_6$ and 100 $\mu$g/mol Ag of $K_3IrCl_6$ were added to a halide solution. After completing addition were further added fine silver iodide grains. The resulting emulsion was comprised-of monodisperse core/shell type silver iodobromochloride cubic grains containing 70 mol % chloride and 0.2 mol % iodide and having an average size of 0.18 $\mu$m and variation coefficient of 10%.

The thus prepared emulsion was desalted using modified gelatin (in which amino groups contained in gelatin were substituted with phenylcarbamyl), e.g., compound G-8, as described in JP-A 2-280139. After desalting, the EAg was 190 mV at 50° C.

To the emulsions were added 100 mg/mol Ag of potassium bromide and citric acid to adjust the pH and EAg to 5.6 and 123 mV and then 170 mg/mol Ag of sodium p-toluenesulfonylchloroamide trihydrate (Chloramine T) was further added thereto. Subsequently 0.6 mg/mol Ag of sulfur simple substance ($S_8$), PM-1200 in the form of solid particles of an average size of 0.5 $\mu$m and dispersed with saponin, which was available from Seishin Kigyo Co.) and 6 mg of chloroauric acid were added and chemically ripened at a temperature of 55° C. until reaching the maximum speed, then 15 mg/mol Ag of $(CF_3SO_3)_3Yb$ was added. Then, 300 mg of sensitizing dye SD-660 was added, and 600 mg/mol Ag of 4-hydroxy-6-methyl-1,3,3a,7-tetrazaindene, 20 mg/mol Ag of 1-phenyl-5-mercaptotetrazole and 300 mg/mol Ag were added and the pH was adjusted to 5.1 with citric acid.

Preparation of Comparative Silver Halide Emulsion 4

Silver bromochloride core grains containing 70 mol % chloride of an average grain size of 0.11 $\mu$m was prepared by the double jet method. Thus, an aqueous silver nitrate solution and an aqueous halide solution were simultaneously added in the presence of 20 $\mu$g $K_3Rh(NO)_4(H_2O)_2$ per mol of total silver , while the pH and silver potential (EAg) were maintained at 3.0 and 165 mV, respectively, at a temperature of 50° C. After the EAg was lowered to 125 mV with sodium chloride, core grains were shelled by the double jet method, in which 20 $\mu$g/mol Ag of $K_3RhCl_6$ and 100 $\mu$g/mol Ag of $K_3IrCl_6$ were added to a halide solution. After completing addition were further added fine silver iodide grains. The resulting emulsion was comprised of monodisperse core/shell type silver iodobromochloride cubic grains containing 70 mol % chloride and 0.2 mol % iodide and having an average size of 0.18 $\mu$m and variation coefficient of 10%.

The thus prepared emulsion was desalted using modified gelatin (in which amino groups contained in gelatin were substituted with phenylcarbamyl), e.g., compound G-8, as described in JP-A 2-280139. After desalting, the EAg was 190 mV at 50° C.

To the emulsions were added 100 mg/mol Ag of potassium bromide and citric acid to adjust the pH and EAg to 5.6 and 123 mV and then 170 mg/mol Ag of sodium p-toluenesulfonylchloroamide trihydrate (Chloramine T) was further added thereto. Subsequently 0.6 mg/mol Ag of sulfur simple substance ($S_8$), PM-1200 in the form of solid particles of an average size of 0.5 $\mu$m and dispersed with saponin, which was available from Seishin Kigyo Co.) and 6 mg of chloroauric acid were added and chemically ripened at a temperature of 55° C. until reaching the maximum speed. Then, 300 mg of sensitizing dye SD-660 was added, and 600 mg/mol Ag of 4-hydroxy-6-methyl-1,3a,7-tetrazaindene, 20 mg/mol Ag of 1-phenyl-5-mercaptotetrazole and 300 mg/mol Ag were added and the pH was adjusted to 5.1 with citric acid.

TABLE 3

| Sample No. | Emulsion Layer: Emulsion | Emulsion Layer: Hydrazine H1 (mg/m$^2$) | Protec-tive Layer: Dextrin (mg/m$^2$) | Sensi-tivity | Fog | Dm | Pepper Fog | Stain | Remark |
|---|---|---|---|---|---|---|---|---|---|
| 5 | 4 | 20 | 50 | 70 | 0.02 | 4.0 | 4 | 4 | Comp. |
| 6 | 4 | 40 | 50 | 100 | 0.08 | 4.90 | 1 | 3 | Comp. |
| 7 | 4 | 20 | 200 | 100 | 0.04 | 4.75 | 3 | 1 | Comp. |
| 8 | 3 | 20 | 20 | 100 | 0.02 | 5.00 | 5 | 5 | Inv. |

Example 3

Photographic material samples 9 to 12 were prepared as described below, provided that a lanthanoid triflate compound was added after chemical ripening. Samples were also evaluated in the same manner as in Example 1. Results thereof are shown in Table 4.

Preparation of Inventive Silver Halide Emulsion

Silver bromochloride core grains containing 70 mol % chloride of an average grain size of 0.11 $\mu$m was prepared by the double jet method. Thus, an aqueous silver nitrate solution and an aqueous halide solution were simultaneously added in the presence of 80 $\mu$g $K_3Rh(NO)_4(H_2O)_2$ per mol of total silver , while the pH and silver potential (EAg) were maintained at 3.0 and 165 mV, respectively, at a temperature of 50° C. After the EAg was lowered to 125 mV with sodium chloride, core grains were shelled by the double jet method, in which 20 $\mu$g/mol Ag of $K_3RhCl_6$ and 100 $\mu$g/mol Ag of $K_3IrCl_6$ were added to a halide solution. After completing addition were further added fine silver iodide grains. The resulting emulsion was comprised of monodisperse core/shell type silver iodobromochloride cubic grains containing 70 mol % chloride and 0.2 mol % iodide and having an average size of 0.18 $\mu$m and variation coefficient of 10%.

The thus prepared emulsion was desalted using modified gelatin (in which amino groups contained in gelatin were substituted with phenylcarbamyl), e.g., compound G-8, as described in JP-A 2-280139. After desalting, the EAg was 190 mV at 50° C.

To the emulsions were added 100 mg/mol Ag of potassium bromide and citric acid to adjust the pH and EAg to 5.6 and 123 mV and then 170 mg/mol Ag of sodium p-toluenesulfonylchloroamide trihydrate (Chloramine T) was further added thereto. Subsequently 0.6 mg/mol Ag of sulfur simple substance ($S_8$), PM-1200 in the form of solid particles of an average size of 0.5 $\mu$m and dispersed with saponin, which was available from Seishin Kigyo Co.) and 6 mg of chloroauric acid were added and chemically ripened at a temperature of 55° C. until reaching the maximum speed. Then, 300 mg of sensitizing dye SD-660 was added, and 600 mg/mol Ag of 4-hydroxy-6-methyl-1,3,3a,7-tetrazaindene, 20 mg/mol Ag of 1-phenyl-5-mercaptotetrazole and 300 mg/mol Ag were added and the pH was adjusted to 5.1 with citric acid.

Preparation of Silver Halide Photographic Material

On the described support opposite to an antistatic layer side were coated a gelatin sublayer (Formula 1) in a gelatin amount of 0.55 g/m$^2$, a silver halide emulsion layer (Formula 2) in a silver amount of 3.3 g/m$^2$ and a gelatin amount of 1 g/m$^2$ and a protective layer (Formula 3) in a gelatin amount of 0.6 g/m$^2$ in this order; and, on the side opposite to the emulsion layer were coated a backing layer in a gelatin amount of 1.5 g/m$^2$ and a backing protective layer in a gelatin amount of 0.8 g/m$^2$. Compositions of backing layers were the same as Formulas 4 and 5 of Example 1. The layers on the emulsion-side were simultaneously coated by the curtain coating method at a coating speed of 200 m/min. and set with cooling, subsequently, the layers on the backing layer-side were simultaneously coated and cooled to −1° C. to be set, and both sides were dried to obtain photographic material samples.

| | |
|---|---|
| Formula 1 (Gelatin sublayer) | |
| Gelatin | 0.55 g/m$^2$ |
| 1-Phenyl-5-mercaptotetrazole | 2.0 g/m$^2$ |
| Fungicide Z | 0.5 g/m$^2$ |
| Dye 1-25 (solid particle dispersion) | 30 g/m$^2$ |
| Formula 2 (Silver halide emulsion layer) | |
| Gelatin | 1 g/m$^2$ |
| Silver halide emulsion | 3.3 g silver-eq./m$^2$ |
| Hydrazine compound H1, in an amount as shown in Table 4 | |
| $(CF_3SO_3)_3Yb$, in an amount as shown in Table 4 | |
| Amine compound Na-21 | 13 mg/m$^2$ |
| SA (sodium isoamyl-n-decylsulfosuccinate) | 1.7 mg/m$^2$ |
| 2-mercaptohypoxanthine | 2 mg/m$^2$ |
| Nicotinic acid amide | 1 mg/m$^2$ |
| n-Propyl gallate | 50 mg/m$^2$ |
| Mercaptopyrimidine | 1 mg/m$^2$ |
| EDTA | 50 mg/m$^2$ |
| Polymer latex L1 | 0.25 mg/m$^2$ |
| Polymer latex L6 | 1.0 mg/m$^2$ |
| Dye k | 10 mg/m$^2$ |
| Phthalated gelatin was used and the pH of a coating solution was 4.8. | |
| Formula 3 (Emulsion-protective layer) | |
| Gelatin | 0.6 g/m$^2$ |
| SA | 12 mg/m$^2$ |
| Matting agent (Spherical polymethyl methacrylate particles of av., size of 3.5 $\mu$m) | 15 mg/m$^2$ |
| Dextrin (product by Meito Sangyo Corp.) in amount as shown in Table 4 | |
| Amorphous silica (av. size 8 $\mu$m) | 13 mg/m$^2$ |
| Surfactant S1 | 30 mg/m$^2$ |
| Lubricant (silicone oil) | 10 mg/m$^2$ |
| Compound a | 50 mg/m$^2$ |
| Polymer latex L6 | 0.3 mg/m$^2$ |
| 1,3-Vinylsulfonyl-2-propanol | 40 mg/m$^2$ |

-continued

| | |
|---|---|
| Hardener h4 | 60 mg/m$^2$ |
| Sodium polystyrenesulfonate | 10 mg/m$^2$ |
| Fungicide Z | 0.5 mg/m$^2$ |
| 2-Mercaptohypoxanthine | 30 mg/m$^2$ |

TABLE 4

| Sample No. | Emulsion Layer $(CF_3SO_3)_3Yb$ (mg/mol Ag) | Emulsion Layer Hydrazine H1 (mg/m$^2$) | Protec-tive Layer Dextrin (mg/m$^2$) | Sensi-tivity | Fog | Dm | Pepper Fog | Stain | Remark |
|---|---|---|---|---|---|---|---|---|---|
| 9 | 0 | 20 | 50 | 50 | 0.02 | 4.9 | 4 | 4 | Comp. |
| 10 | 0 | 40 | 50 | 100 | 0.08 | 5.20 | 1 | 3 | Comp. |
| 11 | 0 | 20 | 200 | 95 | 0.04 | 5.00 | 3 | 1 | Comp. |
| 12 | 15 | 20 | 20 | 110 | 0.02 | 5.25 | 5 | 5 | Inv. |

Example 4

Photographic material samples 13 to 16 were prepared as described below, provided that a lanthanoid triflate compound was added to an emulsion-protective layer. Samples were also evaluated in the same manner as in Example 1. Results thereof shown in Table 5.

Preparation of Inventive Silver Halide Emulsion

Silver bromochloride core grains containing 70 mol % chloride of an average grain size of 0.11 $\mu$m was prepared by the double jet method. Thus, an aqueous silver nitrate solution and an aqueous halide solution were simultaneously added in the presence of 80 $\mu$g $K_3Rh(NO)_4(H_2O)_2$ per mol of total silver , while the pH and silver potential (EAg) were maintained at 3.0 and 165 mV, respectively, at a temperature of 50° C. After the EAg was lowered to 125 mV with sodium chloride, core grains were shelled by the double jet method, in which 20 $\mu$g/mol Ag of $K_3RhCl_6$ and 100 $\mu$g/mol Ag of $K_3IrCl_6$ were added to a halide solution. After completing addition were further added fine silver iodide grains. The resulting emulsion was comprised of monodisperse core/shell type silver iodobromochloride cubic grains containing 70 mol % chloride and 0.2 mol % iodide and having an average size of 0.18 $\mu$m and variation coefficient of 10%.

The thus prepared emulsion was desalted using modified gelatin (in which amino groups contained in gelatin were substituted with phenylcarbamyl), e.g., compound G-8, as described in JP-A 2-280139. After desalting, the EAg was 190 mV at 50° C.

To the emulsions were added 100 mg/mol Ag of potassium bromide and citric acid to adjust the pH and EAg to 5.6 and 123 mV and then 170 mg/mol Ag of sodium p-toluenesulfonylchloroamide trihydrate (Chloramine T) was further added thereto. Subsequently 0.6 mg/mol Ag of sulfur simple substance ($S_8$), PM-1200 in the form of solid particles of an average size of 0.5 $\mu$m and dispersed with saponin, which was available from Seishin Kigyo Co.) and 6 mg of chloroauric acid were added and chemically ripened at a temperature of 55° C. until reaching the maximum speed. Then, 300 mg of sensitizing dye SD-660 was added, and 600 mg/mol Ag of 4-hydroxy-6-methyl-1,3,3a,7-tetrazaindene, 20 mg/mol Ag of 1-phenyl-5-mercaptotetrazole and 300 mg/mol Ag were added and the pH was adjusted to 5.1 with citric acid.

Preparation of Silver Halide Photographic Material

On the described support opposite to an antistatic layer side were coated a gelatin sublayer (Formula 1) in a gelatin amount of 0.55 g/m$^2$, a silver halide emulsion layer (Formula 2) in a silver amount of 3.3 g/m$^2$ and a gelatin amount of 1 g/m$^2$ and a protective layer (Formula 3) in a gelatin amount of 0.6 g/m$^2$ in this order; and, on the side opposite to the emulsion layer were coated a backing layer in a gelatin amount of 1.5 g/m$^2$ and a backing protective layer in a gelatin amount of 0.8 g/m$^2$. Compositions of backing layers were the same as Formulas 4 and 5 of Example 1. The layers on the emulsion-side were simultaneously coated by the curtain coating method at a coating speed of 200 m/min. and set with cooling, subsequently, the layers on the backing layer-side were simultaneously coated and cooled to −1° C. to be set, and both sides were dried to obtain photographic material samples.

| | |
|---|---|
| Formula 1 (Gelatin sublayer) | |
| Gelatin | 0.55 g/m$^2$ |
| 1-Phenyl-5-mercaptotetrazole | 2.0 g/m$^2$ |
| Fungicide Z | 0.5 g/m$^2$ |
| Dye 1-25 (solid particle dispersion) | 30 g/m$^2$ |
| Formula 2 (Silver halide emulsion layer) | |
| Gelatin | 1 g/m$^2$ |
| Silver halide emulsion | 3.3 g silver-eq./m$^2$ |
| Hydrazine compound H1, in an amount as shown in Table 5 | |
| Amine compound Na-21 | 13 mg/m$^2$ |
| SA (sodium isoamyl-n-decylsulfosuccinate) | 1.7 mg/m$^2$ |
| 2-mercaptohypoxanthine | 2 mg/m$^2$ |
| Nicotinic acid amide | 1 mg/m$^2$ |
| n-Propyl gallate | 50 mg/m$^2$ |
| Mercaptopyrimidine | 1 mg/m$^2$ |
| EDTA | 50 mg/m$^2$ |
| Polymer latex L1 | 0.25 mg/m$^2$ |
| Polymer latex L6 | 1.0 mg/m$^2$ |
| Dye k | 10 mg/m$^2$ |
| Phthalated gelatin was used and the pH of a coating solution was 4.8. | |
| Formula 3 (Emulsion-protective layer) | |
| Gelatin | 0.6 g/m$^2$ |
| SA | 12 mg/m$^2$ |
| Matting agent (Spherical polymethyl methacrylate particles of av., size of 3.5 $\mu$m) | 15 mg/m$^2$ |
| Dextrin (product by Meito Sangyo Corp.) in amount as shown in Table 5 | |
| Amorphous silica (av. size 8 $\mu$m) | 13 mg/m$^2$ |
| Surfactant S1 | 30 mg/m$^2$ |
| Lubricant (silicone oil) | 10 mg/m$^2$ |
| Compound a | 50 mg/m$^2$ |
| Polymer latex L6 | 0.3 mg/m$^2$ |
| 1,3-Vinylsulfonyl-2-propanol | 40 mg/m$^2$ |

-continued

| | |
|---|---|
| Lanthanoid triflate $(CF_3SO_3)_3Yb$, in an amount as shown in Table 5 | |
| Hardener h4 | 60 mg/m$^2$ |
| Sodium polystyrenesulfonate | 10 mg/m$^2$ |
| Fungicide Z | 0.5 mg/m$^2$ |
| 2-Mercaptohypoxanthine | 30 mg/m$^2$ |

TABLE 5

| Sample No. | Emulsion Layer Hydrazine H1 (mg/m$^2$) | Protec-tive Layer $(CF_3SO_3)_3Yb$ (mg/mol Ag) | Protec-tive Layer Dextrin (mg/m$^2$) | Sensi-tivity | Fog | Dm | Pepper Fog | Stain | Remark |
|---|---|---|---|---|---|---|---|---|---|
| 13 | 20 | 0 | 50 | 65 | 0.02 | 4.85 | 4 | 4 | Comp. |
| 14 | 40 | 0 | 50 | 100 | 0.08 | 4.95 | 1 | 3 | Comp. |
| 15 | 20 | 0 | 200 | 95 | 0.04 | 4.90 | 3 | 1 | Comp. |
| 16 | 20 | 50 | 20 | 100 | 0.02 | 5.15 | 5 | 5 | Inv. |

As can be seen from Table 3 to 5, photographic materials according to the invention exhibited sufficient speed and maximum density, and being superior in high contrast capability, even when subjected to rapid processing. Improvements in pepper fog and processing stain were also achieved.

Example 5

Photographic material samples 17 to 19 were prepared in a manner similar to Example 3, as shown in Table 6, provided that the hydrazine compound was not incorporated in the silver halide emulsion. Samples were evaluated as described below. Results are shown in Table 6.

Sensitivity, Fog and Maximum Density

Samples were exposed through optical stepped wedge for 1.5×10−7 sec. using a laser sensitometer of 660 nm laser light source and processed using an automatic processor in a manner similar to Example 1. Processed samples were subjected to sensitometry using PDA-65 (Konica Digital Densitometer). In the Table, sensitivity was represented as a transmission density of the optical wedge that gave a density of 0.1, 1.0, 3.0 or 4.0. In this case, the more, the higher sensitivity.

Processing Stain

Processing stain was evaluated in the same manner as in Example 1.

TABLE 6

| Sample No. | Emulsion Layer $(CF_3SO_3)_3Yb$ (mg/mol Ag) | Protective Layer Dextrin (mg/m$^2$) | Sensitivity 0.1 | 1.0 | 3.0 | 4.0 | Dm | Stain | Remark |
|---|---|---|---|---|---|---|---|---|---|
| 17 | 0 | 50 | 1.7 | 1.4 | 0.8 | 0.3 | 4.6 | 4 | Comp. |
| 18 | 0 | 200 | 1.8 | 1.48 | 0.91 | 0.38 | 4.8 | 1 | Comp. |
| 19 | 15 | 20 | 2.05 | 1.62 | 1.05 | 0.6 | 4.9 | 5 | Inv. |

As can be seen from Table 6, samples according to the invention was superior in sensitivity and processing stain.

EFFECT OF THE INVENTION

Silver halide photographic materials according to the invention can be achieved enhanced photographic performance. specifically, even when subjected to extremely short exposure or super-rapid developing or processing, satisfactory speed, and superior high contrast and stability can be achieved.

Disclosed embodiments can be varied by a skilled person without departing from the spirit and the scope of the present invention.

What is claimed is:

1. A silver halide light sensitive photographic material comprising a support having thereon one or plural photographic component layers, wherein at least a photographic component layer contains a lanthanoid triflate compound represented by the following formula (I)

$$Ln—(CF_3SO_3)_3 \qquad \text{formula (I)}$$

wherein Ln represents a rare earth element.

2. The silver halide photographic material of claim 1, wherein the photographic component layer containing the lanthanoid triflate compound is a silver halide emulsion layer containing silver halide grains.

3. The silver halide photographic material of claim 2, wherein said silver halide grains are those which have been subjected to physical ripening in the presence of the lanthanoid triflate compound.

4. The silver halide photographic material of claim 2, wherein said silver halide grains are those which have been subjected to chemical ripening in the presence of the lanthanoid triflate compound.

5. The silver halide photographic material of claim 2, wherein said lanthanoid triflate compound is allowed to be contained after completing chemical ripening of said silver halide grains.

6. The silver halide photographic material of claim 1, wherein the photographic component layers comprise a silver halide emulsion layer and a light-insensitive hydrophilic colloidal layer, said light-insensitive hydrophilic colloidal layer containing the lanthanoid triflate compound.

7. The silver halide photographic material of claim 6, wherein said light-insensitive hydrophilic colloidal layer is a protective layer provided on the silver halide emulsion layer.

8. The silver halide photographic material of claim 1, wherein the photographic component layers comprise a silver halide emulsion layer and a light-insensitive layer, said light-insensitive binder layer containing the lanthanoid triflate compound.

9. The silver halide photographic material of claim 1, wherein at least a photographic component layer contains a hydrazine compound.

10. The silver halide photographic material of claim 9, wherein said hydrazine compound is contained in the photographic component layer containing the lanthanoid triflate compound.

11. The silver halide photographic material of claim 1, wherein said one or plural photographic component layers comprise a silver halide emulsion layer containing silver halide grains, said silver halide grains are core/shell grains comprising a core portion and a shell portion.

12. The silver halide photographic material of claim 11, wherein said core/shell grains each contain a metal compound containing at least one selected from the group consisting of Rh, Re, Ru, Os and Ir, the content of the metal compound being different between the core and shell portions.

13. The silver halide photographic material of claim 11, wherein the core portion and the shell portion are different in halide composition.

14. The silver halide photographic material of claim 11, wherein the shell portion comprises at least two layers, the inner layer and the outermost layer of the core portion are different in halide composition.

15. A silver halide light sensitive photographic material comprising a support having a gelatin sublayer and further having thereon a silver halide emulsion layer and a hydrophilic colloidal layer, wherein said silver halide emulsion layer and/or hydrophilic colloidal layer contain a lanthanoid triflate compound represented by the following formula (I):

$$Ln—(CF_3SO_3)_3 \qquad \text{formula (I)}$$

wherein Ln represents a rare earth element.

* * * * *